US007293672B2

(12) United States Patent
Mori et al.

(10) Patent No.: US 7,293,672 B2
(45) Date of Patent: Nov. 13, 2007

(54) CHEMICAL FEEDING DEVICE

(75) Inventors: Takashi Mori, Ota (JP); Hideyuki Takahashi, Ota (JP); Toshihiko Ota, Ota (JP); Hitoshi Ishiwatari, Tatebayashi (JP); Shinya Uema, Ora-gun (JP); Manabu Haraguchi, Ora-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/505,628

(22) PCT Filed: Feb. 17, 2003

(86) PCT No.: PCT/JP03/01635

§ 371 (c)(1),
(2), (4) Date: Dec. 20, 2004

(87) PCT Pub. No.: WO03/070574

PCT Pub. Date: Aug. 28, 2003

(65) Prior Publication Data

US 2005/0145644 A1 Jul. 7, 2005

(30) Foreign Application Priority Data

Feb. 20, 2002 (JP) ..... 2002-042468
Feb. 20, 2002 (JP) ..... 2002-042485
Feb. 20, 2002 (JP) ..... 2002-042500

(51) Int. Cl.
*B65H 1/00* (2006.01)

(52) U.S. Cl. ..... 221/122; 221/130; 221/131; 700/242; 53/154

(58) Field of Classification Search ..... 221/123, 221/124, 129, 130, 131; 53/154, 168, 155, 53/237, 238, 247; 700/242, 241
See application file for complete search history.

(56) References Cited

U.S. PATENT DOCUMENTS 4,664,289 A * 5/1987 Shimizu et al. ..... 221/2

(Continued)

FOREIGN PATENT DOCUMENTS

EP 0 615 909 A1 9/1994

(Continued)

OTHER PUBLICATIONS

Patent Abstracts of Japan, Publication No. JP 02-269601, "Medicine-Tablet Dispenser of Tablet-Parceling Machine", Tokyo Shokai, Nov. 11, 1990.

(Continued)

*Primary Examiner*—Gene O. Crawford
*Assistant Examiner*—Timothy Waggoner
(74) *Attorney, Agent, or Firm*—Darby & Darby

(57) ABSTRACT

In a medicine supply apparatus having a plurality of tablet cases equipped in a case accommodating portion of a main body, each tablet case containing medicines, chutes into which medicines discharged from the respective table cases fall, a hopper equipped in correspondence with the lower portions of the chutes, and a charging apparatus for charging a medicine accommodating container with medicines caught by the hopper, a plurality of drawers are equipped in the case accommodating portion, the tablet cases are detachably mounted on each drawer, and each drawer is equipped so as to be freely drawn out from the case accommodating portion.

30 Claims, 37 Drawing Sheets

U.S. PATENT DOCUMENTS

| | | | | |
|---|---|---|---|---|
| 5,709,063 | A * | 1/1998 | Yuyama et al. | 53/154 |
| 5,901,876 | A * | 5/1999 | Yuyama et al. | 221/133 |
| 6,170,229 | B1 | 1/2001 | Kim | |
| 6,175,779 | B1 * | 1/2001 | Barrett | 700/242 |
| 6,349,999 | B1 * | 2/2002 | Takahashi et al. | 312/209 |
| 6,471,090 | B1 | 10/2002 | Inamura et al. | |

FOREIGN PATENT DOCUMENTS

| | | | |
|---|---|---|---|
| EP | 0 760 234 | A1 | 3/1997 |
| EP | 0 945 117 | A2 | 9/1999 |
| EP | 1 053 738 | A2 | 11/2000 |
| JP | 55-88702 | | 6/1980 |
| JP | 2-131901 | U | 11/1990 |
| JP | 3-19808 | U | 2/1991 |
| JP | 3-102401 | U | 10/1991 |
| JP | 05-132007 | A1 | 5/1993 |
| JP | 06-298226 | A1 | 10/1994 |
| JP | 08-119201 | A1 | 5/1996 |
| JP | 11-278401 | A1 | 10/1999 |
| WO | WO-00/18644 | A1 | 4/2000 |
| WO | WO-01/60726 | A1 | 8/2001 |

OTHER PUBLICATIONS

Patent Abstracts of Japan, Publication No. JP 2000-318703, "Drug Feed Chute for Drug Subdivision Packer", Yuyama Manufacturing Co. Ltd., Nov. 21, 2000.

Patent Abstracts of Japan, Publication No. 2000-085702, "Medicine Packaging Device", Yuyama Seisakusho, Mar. 28, 2000.

* cited by examiner

CHEMICAL FEEDING DEVICE

TECHNICAL FIELD

The present invention relates to a medicine supply apparatus for supplying a container (bottle, bag or the like) with medicines accommodated in a tablet case by a prescribed number indicated by a medical prescription in a hospital, a pharmacy or the like.

BACKGROUND ART

In a hospital or pharmacy, it has been general that medicines prescribed by a doctor are supplied to a patient by using a medicine supply apparatus disclosed in JP-UM-B-57-5282 (B65B1/30) (it is referred to as a tablet packaging machine in this publication), for example. According to this system, medicines (tablets, capsules or the like) whose number is indicated in a medical prescription are discharged from the inside of a tablet case one by one by using a discharge drum (referred to as an array board in the above publication), passed through a chute and then collected in a hopper. Thereafter, the medicines thus collected are packaged with packaging paper or put in a bottle An extremely large number of tablet cases are accommodated in a case accommodating portion of such a medicine supply apparatus in accordance with the types of medicines. Furthermore, each tablet case is normally detachably mounted in the case accommodating portion because the types of medicines are renewed or medicines are supplemented, and thus some space for mounting/detaching each tablet case on/from the case accommodating portion must be kept at the upper side of each tablet case. For this reason, the case accommodating portion of the medicine supply apparatus must be dimensionally scaled up in connection with multiplication of the types of medicines to be treated, and thus the whole size of the medicine supply apparatus is increased. Therefore, an improvement has been required.

Furthermore, in the medicine supply apparatus described above, tablet cases, chutes, a hopper, etc. may be polluted with fine powder occurring from medicines, or a packaging machine for packaging medicines into packaging paper and a bottling machine for bottling medicines (both are charging machines) have a risk that they have a breakdown because they have relatively complicated mechanisms. However, in the conventional medicine supply apparatus as described above, particularly the hopper and the charging machines are fixed in the main body of the apparatus, and thus it has been remarkably difficult to carry out maintenance such as cleaning, exchanging of parts, etc. on these machines.

Still furthermore, various kinds of containers to be charged with medicines, for example, packages achieved by subjecting packaging paper to heat-adhesion, so-called blister packages, etc. are used in connection with application fields. However, as described above, in the conventional medicine supply device, the charging machines such as the packaging machine, the bottling machine, etc. are designed to be fixed in the main body of the medicine supply apparatus in advance, and thus plural types of medicine supply apparatuses each of which is equipped with a charging apparatus such as a bottling machine, a packaging machine, a blister packaging machine or the like are manufactured in connection with the types of contains for medicines. Therefore, there has been a problem that the manufacturing cost and the part managing cost are increased.

Particularly when medicines are packaged and divided into packages in the medicine supply apparatus described above, a nozzle is fixed to an outlet at the lower end of a hopper for catching medicines, the nozzle is inserted into heat-adhesive packaging paper wound in a roll shape, and then medicines are charged in the packaging paper. Accordingly, if the feeding position of the packaging paper and the nozzle position are not accurately matched with each other, the packaging paper is unnecessarily expansively opened, so that some trouble occurs in heat-adhesion or some trouble occurs in the feeding operation of the packaging paper itself. Therefore, the securing positions of the hopper and the nozzle must be strictly specified, and it has been difficult to perform a fabrication work.

The present invention has been implemented to solve the conventional technical problem as described above, and has an object to provide a medicine supply apparatus which can suppress scale-up thereof with increasing the number of tablet cases to be accommodated in the medicine supply apparatus.

Furthermore, the present invention has another object to provide a medicine supply apparatus in which maintenance such as cleaning, exchanging of parts, etc. can be remarkably easily performed.

Still furthermore, another object of the present invention is to provide a medicine supply apparatus which can be improved in generality and convenience and save the cost.

DISCLOSURE OF THE INVENTION

According to the present invention, a medicine supply apparatus comprising plural tablet cases equipped in a case accommodating portion of a main body thereof, each of the table cases having medicines accommodated therein, chutes through which medicines discharged from the tablet cases are passed, a hopper equipped so as to face the lower portions of the chutes, and a charging apparatus for charging a medicine accommodating container with medicines caught by the hopper is characterized in that a plurality of drawers are equipped in the case accommodating portion so as to be freely drawn out, and the tablet cases are detachably mounted on the drawers.

In the above medicine supply apparatus, each of the drawers has a passage passing in an up-and-down direction at the center thereof, the tablet cases are mounted at both the sides of the respective passages, the passages of the respective drawers mutually intercommunicate with one another under a state that the drawers are accommodated in the case accommodating portion, whereby the chutes are linked to one another in the up-and-down direction.

The above medicine supply apparatus further comprises an additional unit connected to the upper side of the main body, wherein a plurality of drawers are equipped in the additional unit so as to be freely drawn out, tablet cases are detachably mounted on the drawers, and under a state that the plural drawers of the additional unit are accommodated in the additional unit, passages which are equipped at the centers of the drawers of the additional unit and intercommunicate with one another in the up-and-down direction intercommunicate with the passages of the drawers accommodated in the case accommodating portion, thereby forming chutes extending from the additional unit through the case accommodating portion so that the chutes are continuous with one another in the up-and-down direction.

In the above medicine supply apparatus, each of the drawers is designed so that tablet cases can be mounted thereon or no tablet case is mounted thereon.

In the above medicine supply apparatus, each of the drawers is designed so that different types of tablet cases and corresponding tablet cases can be mounted thereon.

In the above medicine supply apparatus, the different types of tablet cases are tablet cases which are different in size or shape or different in the type of medicines to be accommodated in the tablet cases.

The above medicine supply apparatus further comprises regulating means for prohibiting neighboring drawers from being simultaneously drawn out.

In the above medicine supply apparatus, the drawers are equipped on plural columns in the right-and-left direction and plural stages in the up-and-down direction in the case accommodating portion, and the regulating means prohibits simultaneous draw-out of the neighboring drawers on a column basis or on a stage basis.

In the above medicine supply apparatus, the regulating means comprises a stay which is rotatably disposed at the rear side of the inside of the case accommodating portion in correspondence with the rear portions of the drawers located on each column or stage, and upon draw-out of any drawer, the stay prohibits draw-out of other drawers located in the same column or stage as the drawer concerned.

The above medicine supply apparatus further comprises lock means for prohibiting draw-out of the drawers.

In the above medicine supply apparatus, the lock means is of an electric motor-drive-n type.

In the above medicine supply apparatus, the operation of the lock means is prohibited when any drawer is drawn out.

The above medicine supply apparatus further comprises lock release means for releasing the lock means.

In the above medicine supply apparatus, the lock release means is of a manual type.

According to the present invention, a medicine supply apparatus comprising plural tablet cases equipped in a case accommodating portion of a main body thereof, each of the table cases having medicines accommodated therein, chutes through which medicines discharged from the tablet cases are passed, a hopper equipped so as to face the lower portions of the chutes, and a charging apparatus for charging a medicine accommodating container with medicines caught by the hopper, is characterized in that the main body comprises an upper structure in which the tablet cases are equipped, and a lower structure which is detachably joined to the lower side of the upper structure and in which the charging apparatus is set up, and any one of plural types of lower structures in which different charging apparatuses are respectively set up in accordance with the types of containers to be charged with medicines is selectively joined to the upper structure.

In the above medicine supply apparatus, the charging apparatus comprises any one of a packaging machine for charging and packaging medicines in packaging paper, a bottling machine for bottling medicines and a blister packaging machine, and the lower structure in which any one of the packaging machine, the bottling machine and the blister packaging machine is mounted is selectively joined to the upper structure.

The above medicine supply apparatus further comprises a shutter which is detachably secured to the main body so as to be freely opened/closed and temporarily catches medicines falling from the chutes to the hopper.

In the above medicine supply apparatus, the shutter and the hopper are equipped so as to be simultaneously drawn out from the main body.

In the above medicine supply apparatus, the shutter is equipped with a buffer member for absorbing impact of medicines falling from the chutes.

In the above medicine supply apparatus, the shutter comprises a pair of slope walls which are separated from each other while sloping in an upward direction, and an opening/closing plate for freely opening/closing an opening formed between the lower ends of the slope walls, and the buffer member is downwardly suspended at the center between the slope walls so as to face the slope walls.

In the above medicine supply apparatus, the lower end of the buffer member extends further downwardly from the opening.

In the above medicine supply apparatus, the lower end of the buffer member extends downwardly so as to be pinched by the opening/closing plate while the opening/closing plate is set to a close state.

According to the present invention, a medicine supply apparatus comprising plural tablet cases equipped in a case accommodating portion of a main body thereof, each of the table cases having medicines accommodated therein, chutes through which medicines discharged from the tablet cases are passed, a hopper equipped so as to face the lower portions of the chutes, and a charging apparatus for charging a medicine accommodating container with medicines caught by the hopper, is characterized in that the tablet cases, the hoper and the charging apparatus are equipped so as to be drawn out and detached from the main body.

In the above medicine supply apparatus, the tablet cases are equipped so that a plurality of tablet cases can be simultaneously drawn out and detached from the main body.

The above medicine supply apparatus further comprises a shutter which is equipped in the main body so as to be freely opened/closed and temporarily catches medicines falling from the chutes to the hopper, and the shutter being equipped so as to be drawn out and detached from the main body.

In the above medicine supply apparatus, the shutter and the hopper are equipped so as to be simultaneously drawn out from the main body.

In the above medicine supply apparatus, the shutter is equipped with a buffer member for absorbing impact of medicines falling from the chutes.

In the above medicine supply apparatus, the shutter comprises a pair of slope walls which are separated from each other while sloping in an upward direction, and an opening/closing plate for freely opening/closing an opening formed between the lower ends of the slope walls, and the buffer member is downwardly suspended at the center between the slope walls so as to face the slope walls.

In the above medicine supply apparatus, the lower end of the buffer member extends further downwardly from the opening.

In the above medicine supply apparatus, the lower end of the buffer member extends downwardly so as to be pinched by the opening/closing plate while the opening/closing plate is set to a close state.

In the above medicine supply apparatus, the charging apparatus is equipped with heat-adhesive packaging paper wound in a roll shape and a nozzle which is inserted in the packaging paper continuously drawn out and puts medicines discharged from the tablet cases into the packaging paper, and the nozzle is designed to be freely swingable in a direction perpendicular to a feeding direction of the packaging paper.

According to the present invention, in the medicine supply apparatus comprising plural tablet cases equipped in a case accommodating portion of a main body thereof, each of the table cases having medicines accommodated therein, chutes through which medicines discharged from the tablet cases are passed, a hopper equipped so as to face the lower portions of the lower portions of the chutes, and a charging apparatus for charging a container such as a bag, a bottle or the like with medicines caught by the hopper, drawers of plural stages are equipped in the case accommodating portion, plural tablet cases are mounted on each drawer, and each drawer is enabled to be freely drawn out from the case accommodating portion. Therefore, when a tablet case is supplemented with medicines or exchanged by a new one, the supplement or exchange can be performed by drawing out each drawer.

Accordingly, as compared with the structure that respective drawers arranged in the up-and-down direction are simultaneously drawn out, the gap to be formed between the upper and lower drawers for medicine supplement or exchange can be reduced more greatly, and thus the number of tablet cases to be accommodated in the case accommodated portion can be increased with suppressing scale-up of the dimension of the overall medicine supply apparatus.

BEST MODES FOR CARRYING OUT THE INVENTION

Figure 1:
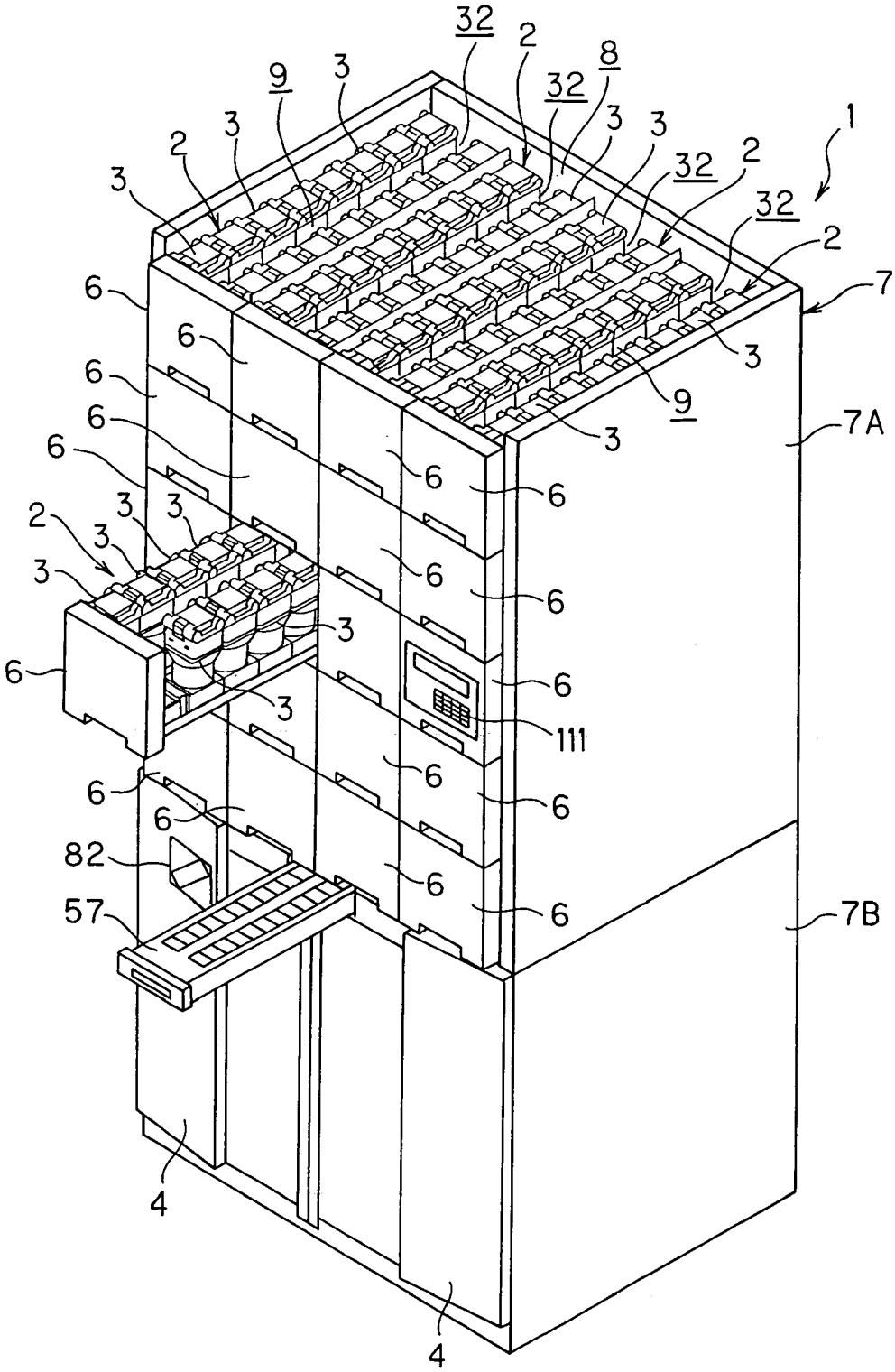
FIG. 1 is a perspective view of a medicine supply apparatus according to an embodiment of the present invention (excluding a top board)
Figure 2:
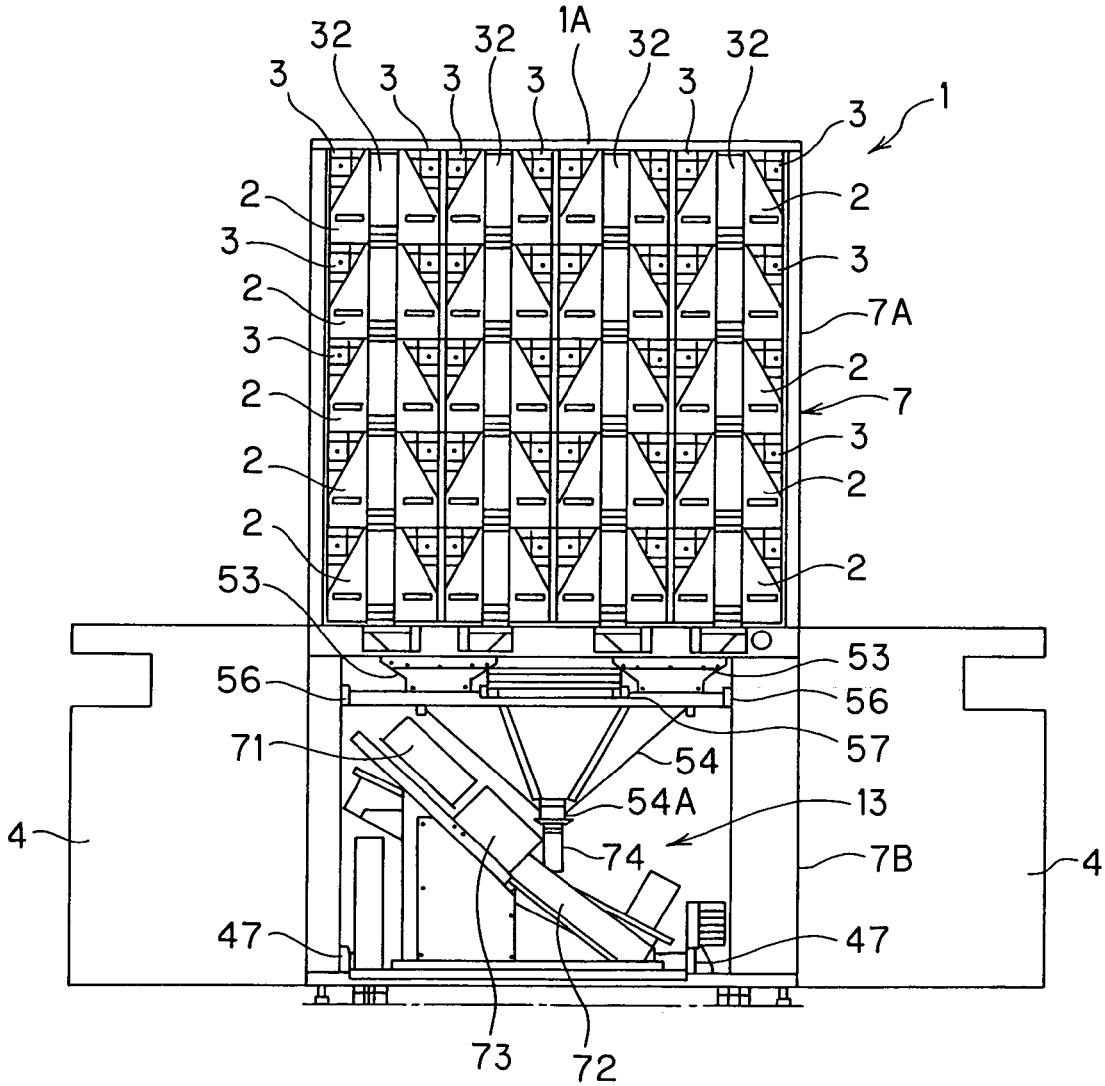
FIG. 2 is a front view of the medicine supply apparatus of FIG. 1 when a cover panel of each drawer is detached and a lower panel is opened.
Figure 3:
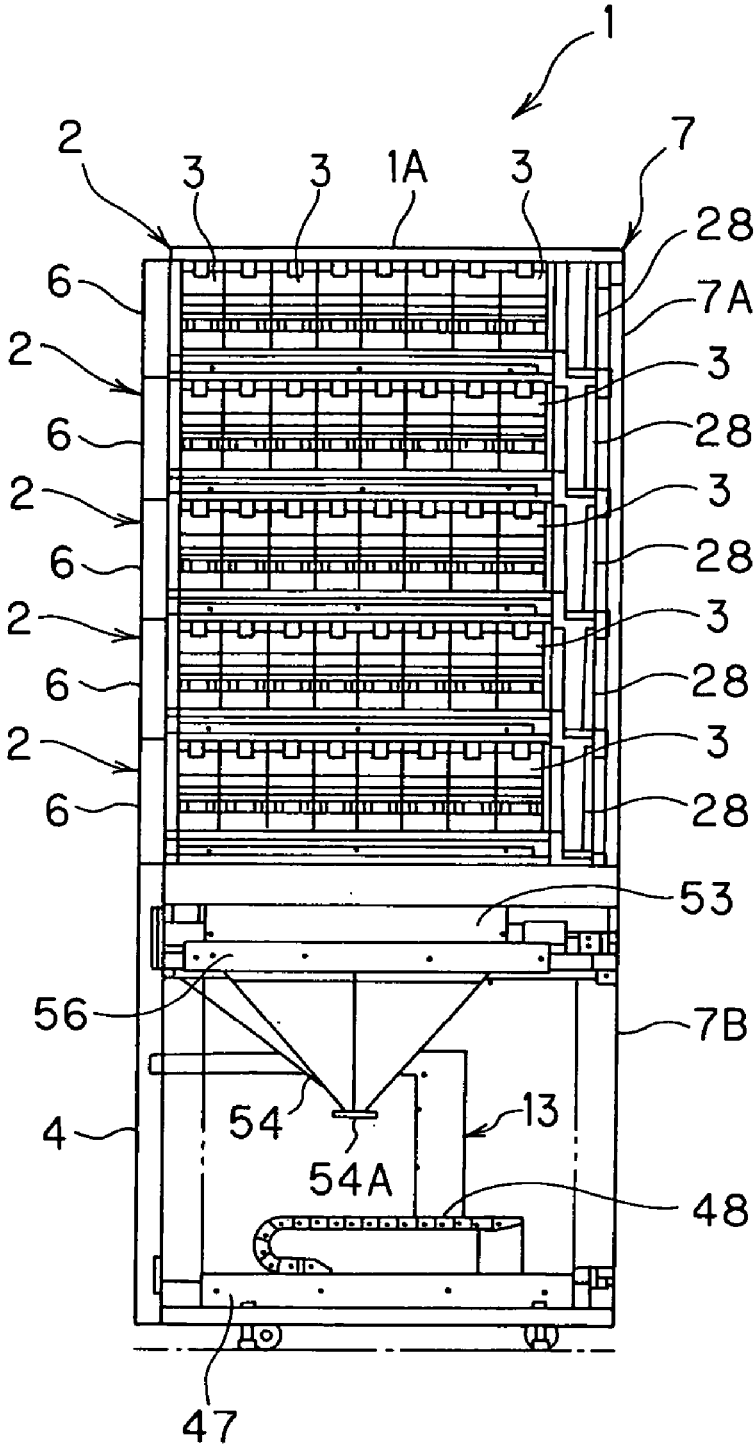
FIG. 3 is another front view of the medicine supply apparatus shown in FIG. 1.
Figure 4:
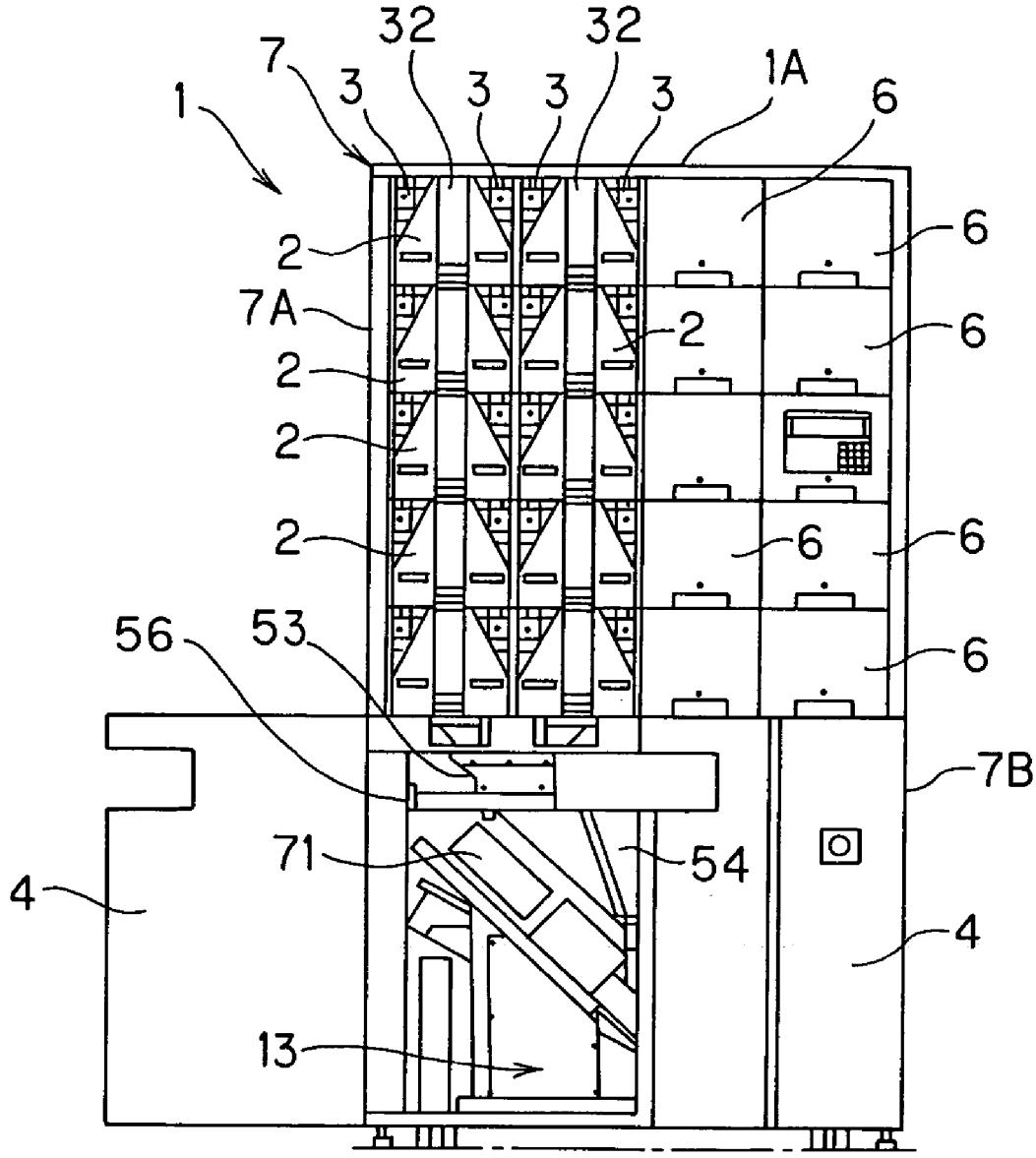
Figure 5:
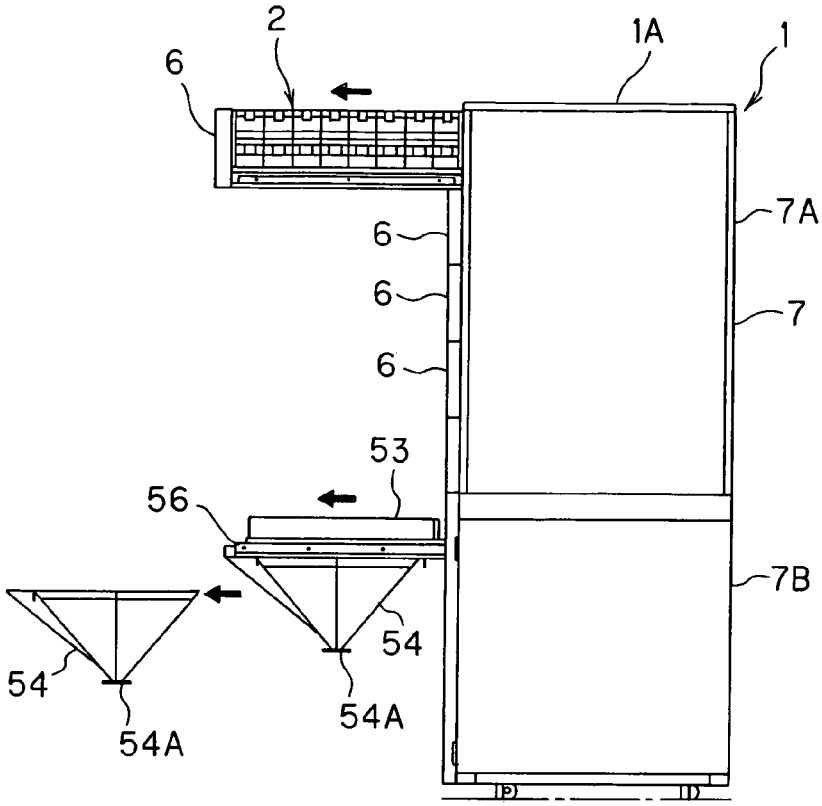
FIG. 5 is a side view of the medicine supply apparatus.
Figure 6:
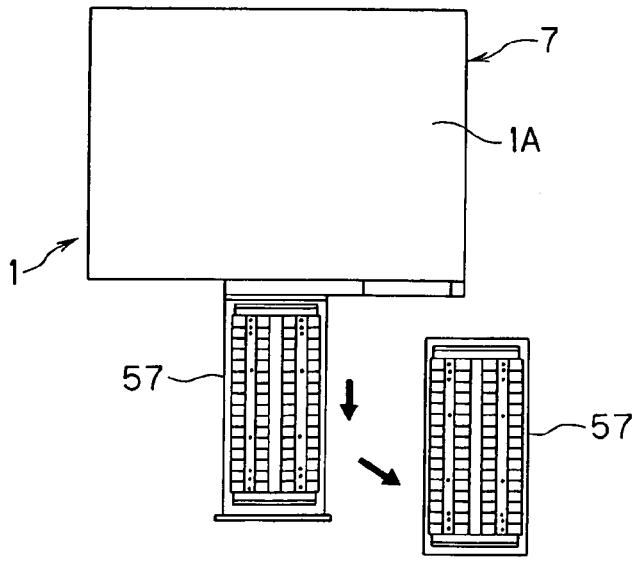
FIG. 6 is a plan view of the medicine supply apparatus shown in FIG. 1.
Figure 7:
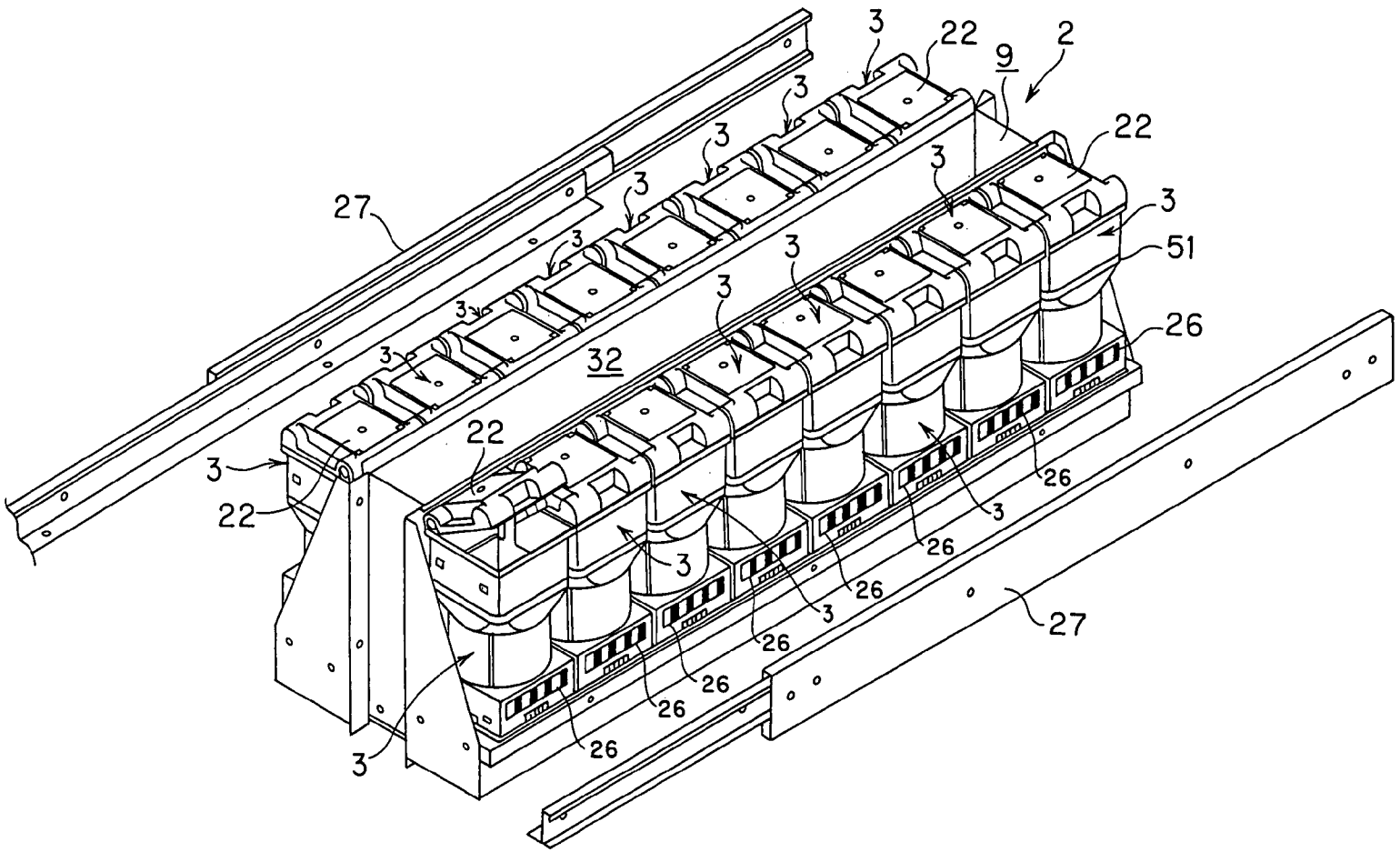
FIG. 7 is a perspective view of drawers of the medicine supply apparatus shown in FIG. 1.
Figure 8:
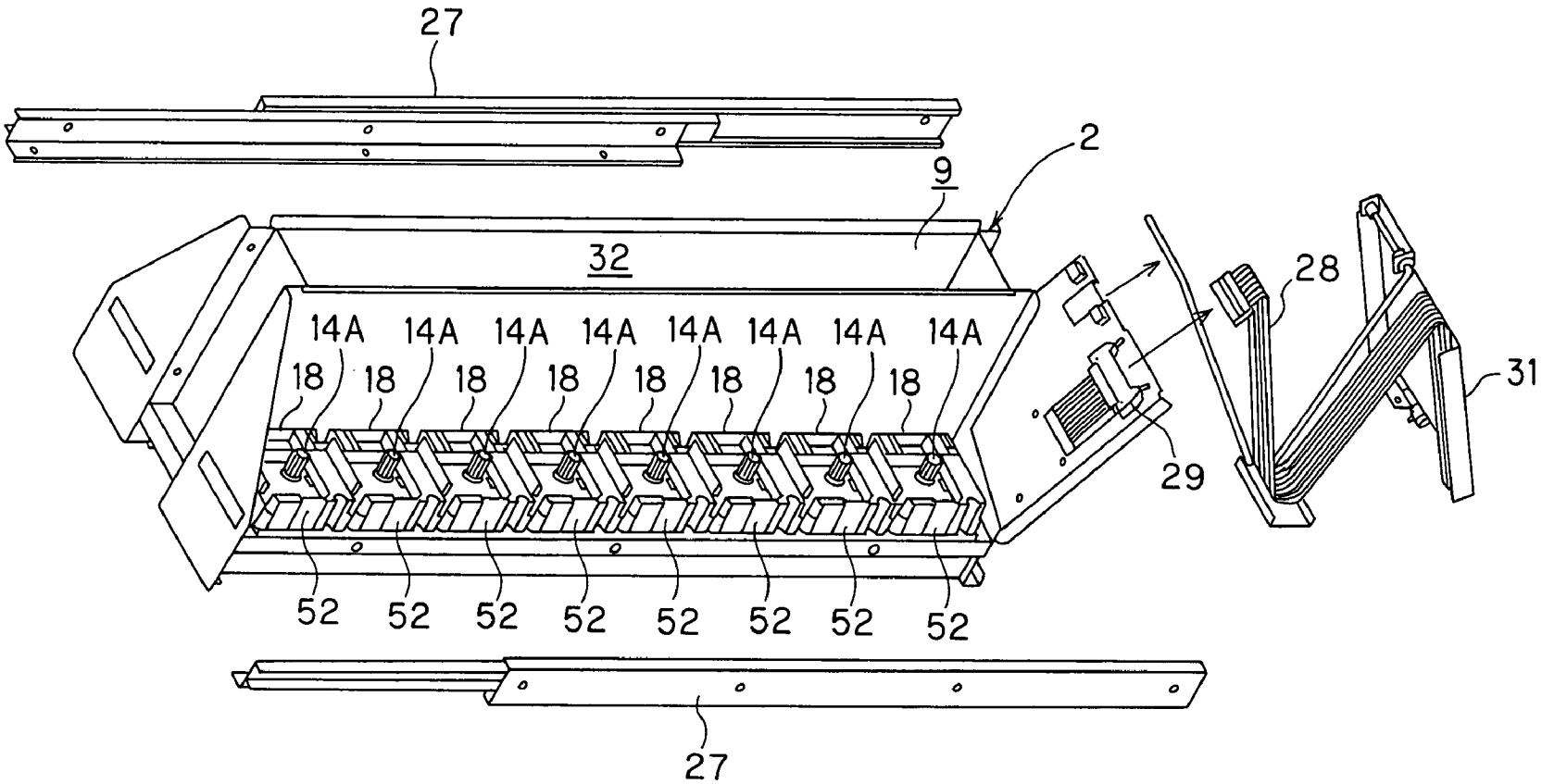
FIG. 8 is a perspective view showing the drawers of FIG. 7 when the accommodating container of the tablet cases is detached.
Figure 9:
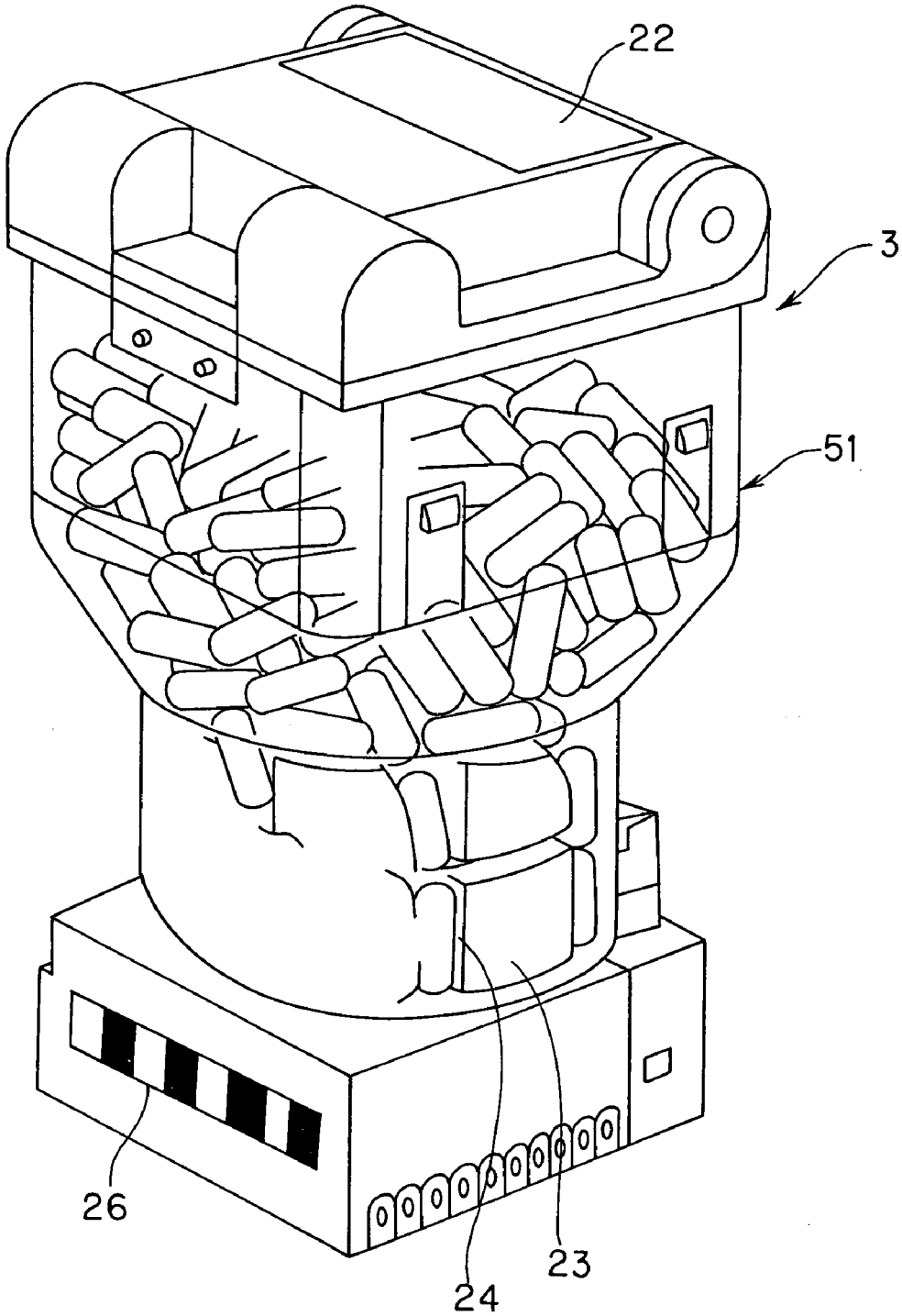
FIG. 9 is a perspective view of the accommodating container of the tablet cases of the medicine supply apparatus shown in FIG. 1.
Figure 10:
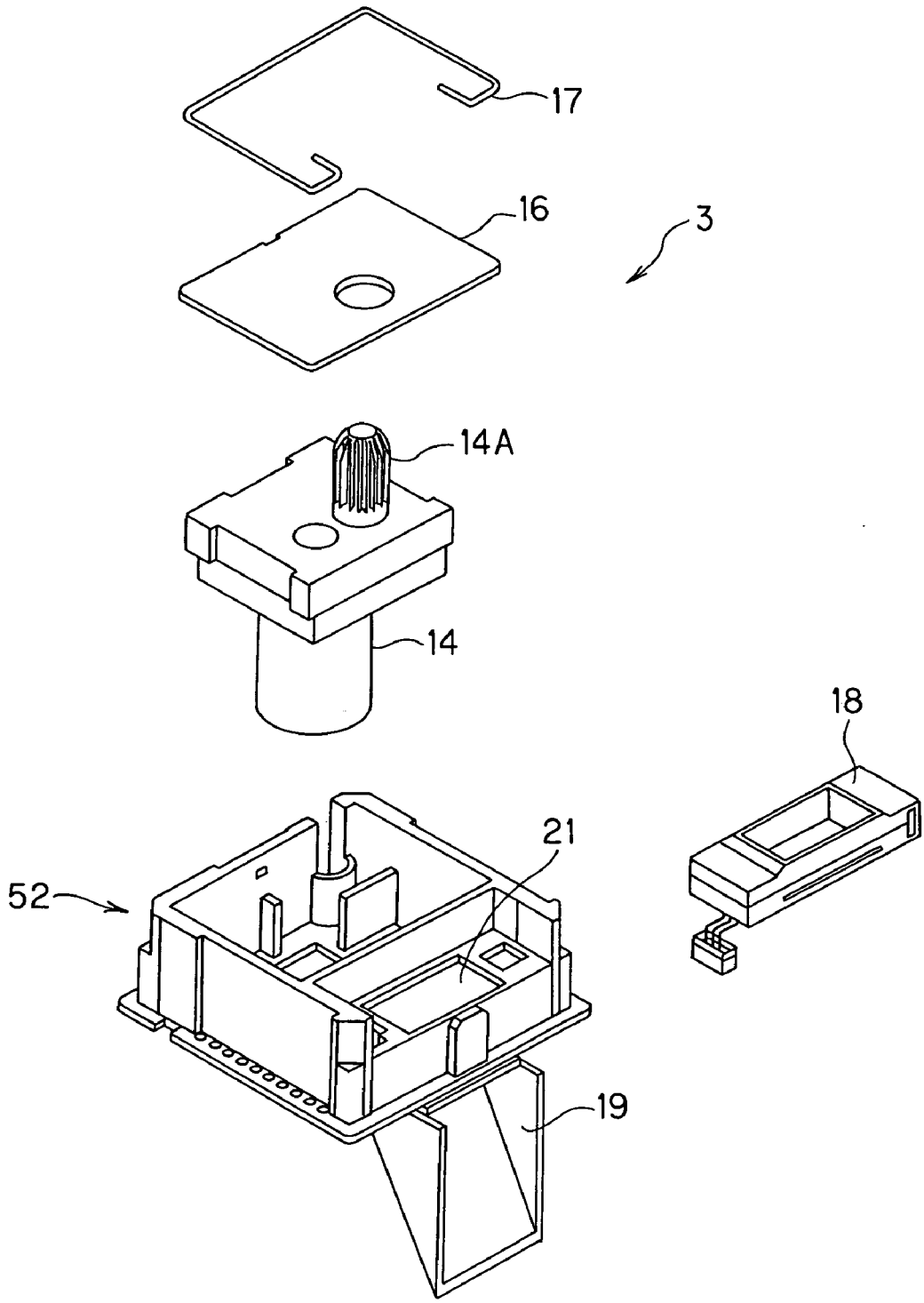
FIG. 10 is an exploded perspective view showing a driving base of the tablet case of the medicine supply apparatus of FIG. 1.
Figure 11:
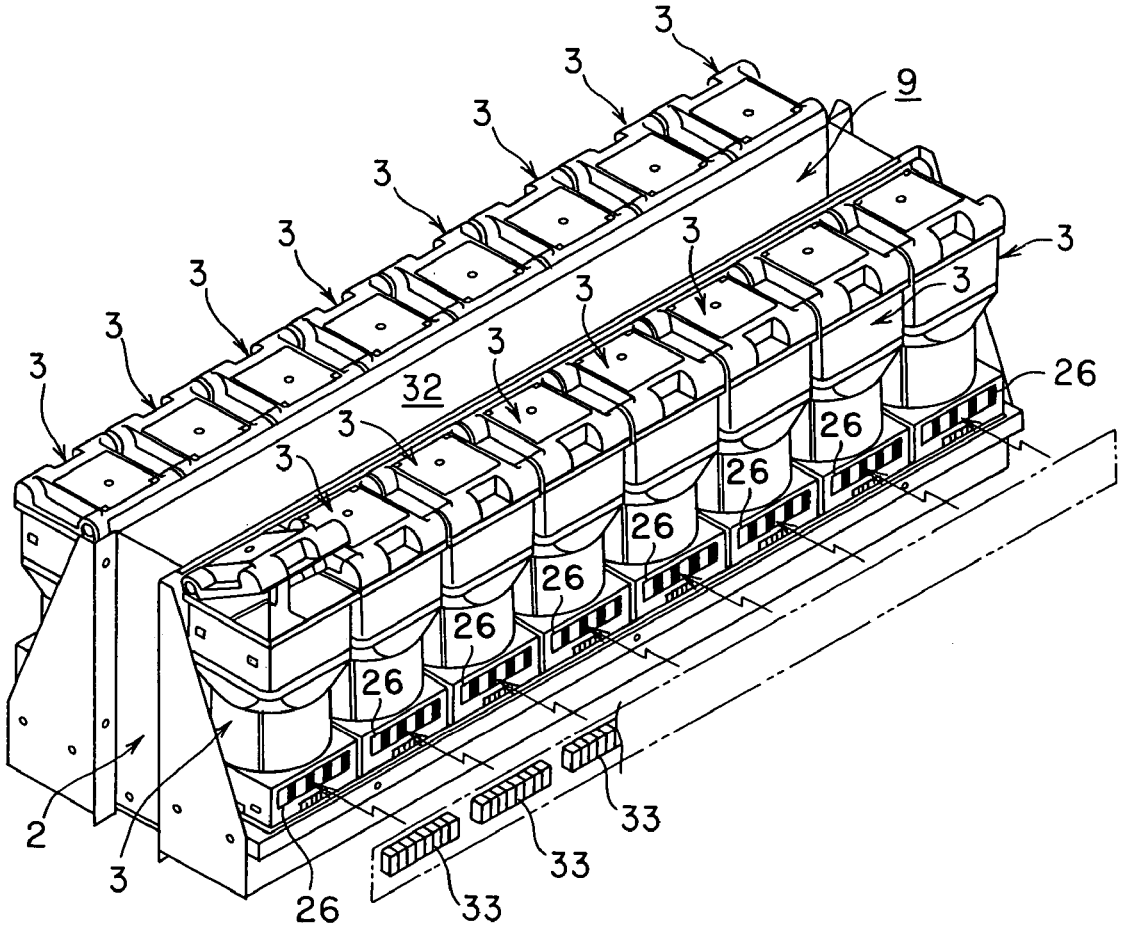
FIG. 11 is a perspective view showing a shelve of the medicine supply apparatus and identifying sensors.
Figure 12:
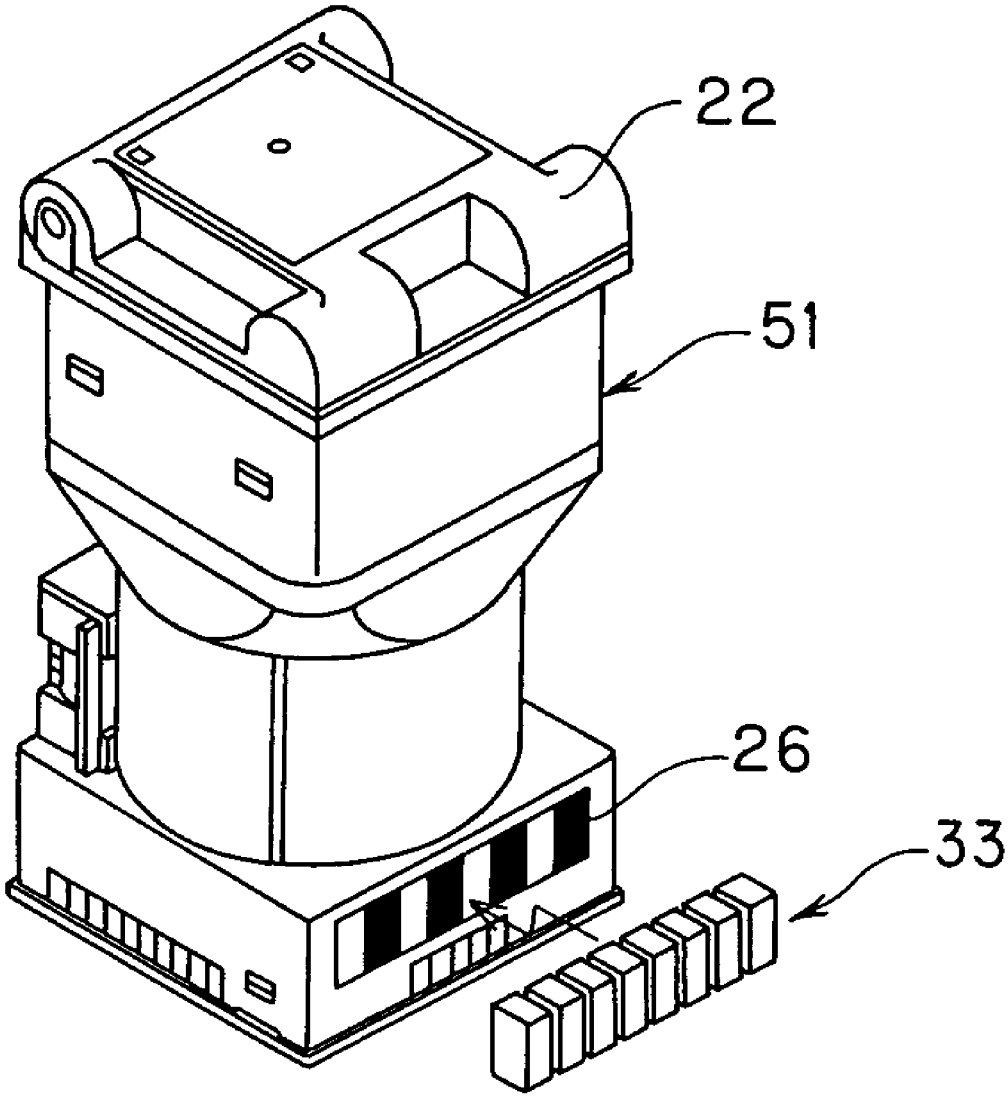
FIG. 12 is a perspective view showing a tablet case and an identifying sensor of the medicine supply apparatus of FIG. 1.

Embodiments of the present invention will be described in detail with reference to the drawings. FIG. 1 is a perspective view of a medicine supply apparatus 1 (excluding a top board 1A) according to an embodiment of the present invention, FIG. 2 is a front view of the medicine supply apparatus 1 under a state that a cover panel 6 of each drawer 2 is detached and lower panels 4 are opened, FIG. 3 is a longitudinally-sectional side view of the medicine supply apparatus 1, FIG. 4 is another front view of the medicine supply apparatus 1, FIG. 5 is a side view of the medicine supply apparatus 1, FIG. 6 is a plan view showing the medicine supply apparatus 1, FIG. 7 is a perspective view of a drawer 2, FIG. 8 is a perspective view of the drawer 2 under the state that an accommodating container 51 of the tablet cases 3 is detached, FIG. 9 is a perspective view showing the accommodating container 51 of the tablet cases 3, FIG. 10 is an exploded perspective view showing a driving base 52 of each tablet case 3, FIG. 11 is a perspective view showing a drawer and identifying sensors 33, and FIG. 12 is a perspective view showing the tablet cases 3 and the identifying sensors 33.

The medicine supply apparatus 1 of this invention is set up in a hospital, a pharmacy or the like, and it comprises an elongated rectangular main body 7 and a personal computer PC for control described later. The main body 7 comprises an upper structure 7A and a lower structure 7B which are mutually separable from each other, and the upper structure 7A is joined to the lower structure 7B while mounted on the lower structure 7B. A case accommodating portion 8 is constructed inside the upper structure 7A so that the front, upper and lower faces thereof are opened, and the opened top face of the case accommodating portion 8 is closed by a detachable top board 1A.

Furthermore, the lower structure 7B is designed so that the front and upper faces thereof are opened, and it intercommunicates with the upper structure 7A at the upper face thereof. A packaging machine 13, etc. are accommodated as a charging apparatus in the lower structure 7B, and the opening of the front face of the lower structure 7B is closed by double-doored lower panels 4 so that the opening can be freely opened/closed.

Drawers 2 are arranged on four columns in the right-and-left direction and five stages in the up-and-down direction (totally twenty drawers) in the case accommodating portion 8 of the upper structure 7A. A door panel 6 is secured to the front end of each drawer 2, and the door panels 6 close the opening of the front face of the upper structure 7A (case accommodating portion 8) under the state that all the drawers 2 are accommodated in the case accommodating portion 8. A passage 9 is formed at the center of each drawer so as to extend in the front-and-rear direction. The passages 9 thus formed in the respective drawers intercommunicate with one another in the up-and-down direction, and every eight (totally sixteen) driving bases 52 of tablet cases 3 are juxtaposed with one another at both the right and left sides of each passage 9 in the front-and-rear direction (FIG. 7, FIG. 8). The tablet case 3 comprises the driving base 52 and the accommodating container 51 joined onto the driving base 52.

A drum motor 14 for driving a drum (that is, a rotating motor having a rectifying brush) is accommodated from the upper side in the driving base 52 so as to be fixed to the driving base 52 by a cover 16 and a clip 17. Under this state, a driving shaft 14A of the drum motor 14 projects upwardly from the cover 16 (FIG. 10). Furthermore, an optical medicine detecting sensor 18 is secured to a discharge port 21 formed in the driving base 52, and a discharging chute 19 extending from the discharging port 21 obliquely downwardly is formed in the driving base 52 located below the medicine detecting sensor 18 (FIG. 10). The discharging chute 19 is opened so as to intercommunicate with the passage 9 described above.

The top face of the accommodating container 51 of the tablet case 3 is opened, and the opening of the accommodating container 51 is closed by a lid 22 which is freely opened/closed (FIG. 9). A discharging drum 23 is secured at the bottom portion in the accommodating container 51, and plural longitudinal grooves 24 are formed at predetermined intervals on the circumference of the side surface of the discharging drum 23. Medicines are filled from the opening of the upper face of the accommodating container 51 into the inside of the accommodating container 51 (the lid 22 is opened), and every two medicines are put into each longitudinal groove of the discharging drum 23. An optically-identifiable identification code (bar code or the like) 26 is attached to the side surface of the lower portion of the accommodating container 51. The identification code 26 is a code for identifying the type of the medicines charged in the corresponding accommodating container 51.

The accommodating container 51 is mounted on the driving base 52 described above so as to be detachably joined to the driving base 52. In this case, the identification code is attached so as to face the outside of the drawer 2 (the opposite side to the passage 9). Through the above fabrication, each tablet case 3 is constructed. At this time, the discharging drum 23 is freely detachably fitted to the driving shaft 14A of the drum motor 14. When the drum motor 14 is forwardly driven, the discharging drum 23 is forwardly rotated, and each longitudinal groove 24 is successively matched with the discharging port 21 of the driving base 52, so that medicines put in each longitudinal groove 24 fall down to the discharging chute 19 one by one.

The medicines passing through the discharging port 21 are detected by the medicine detecting sensor 18. The medicines falling into the discharging chute 19 are discharged to the passage 9 of the drawer 2. When the accommodating container 51 becomes vacant, the accommodating container 51 is detached from the driving base 52 and charged with medicines.

As described above, each drawer 2 on which plural tablet cases 3 are mounted is detachably fitted to a pair of right and left drawing rails 27 secured in the case accommodating portion 8 of the upper structure 7A by screws. Accordingly, the drawers 2 and the plural tablet cases 3 secured to the drawers 2 are accommodated in the case accommodating portion 8 so as to be freely drawn out from the case accommodating portion 8 and also detachable from the drawing rails 27 under the state that they are drawn out (FIG. 5).

A harness 28 for supplying current (power supply) to the drum motor 14 of each tablet case 3 and also transferring an output from the medicine detecting sensor 18 is detachably secured to the rear end of each drawer 2 through a connector 29. The harness 28 is designed to be longer than the draw-out distance of the drawer 2, and it is held by a wire holding member 31 which is secured to the upper structure 7A and expanded and contracted by folding (FIG. 8).

Under the state that the drawers 2 are accommodated in the case accommodating portion 8, the passages 9 of respective drawers 2 located at the upper and lower positions face each other, and form a series of chutes 32 intercommunicating with one another in the up-and-down direction. Accordingly, according to this embodiment, chutes 32 which are arranged on four columns in the right-and-left direction so as to extend in the up-and-down direction are constructed in the case accommodating portion 8. Since the drawers which can be freely drawn out independently of one another are equipped at plural stages in the up-and-down direction in the case accommodating portion 8, each drawer 2 can be drawn out when the accommodating container 51 of each tablet case 3 is exchanged or the like.

Accordingly, as compared with the structure that drawers arranged on one column in the up-and-down direction are simultaneously drawn out, the gap interval to be formed between the upper and lower drawers 2 to exchange some accommodating container 51 can be more greatly reduced, and thus the number of tablet cases 3 which can be accommodated in the case accommodating portion 8 can be increased without causing the medicine supply apparatus 1 to be large in size. Furthermore, the passage 9 is formed at the center of each drawer 2, and the chutes 32 extending so as to intercommunicate with one another in the up-and-down direction are formed by the respective passages 9 in the up-and-down direction while the upper and lower drawers 2 are accommodated in the case accommodating portion 8. Therefore, as compared with the structure that a chute is constructed at the side portion of each drawer 2, the gap interval of the chutes 32 located at the right and left ends can be more greatly reduced. Accordingly, the opening areas of the upper faces of a shutter 53 and a hopper 54 can be reduced, and thus they can be miniaturized.

At the right and left sides in the case accommodating portion 8 of the upper structure 7A, plural optical identification sensors 33 are equipped in connection with the tablet cases 3 of the respective drawers 2 at the right and left ends (FIG. 11, FIG. 12). The respective identification sensors 33 are disposed so as to face the identification codes 26 of the tablet cases 3 located at one sides of the respective drawers 2 which face the right and left side surfaces of the case accommodating portion 8, and used to read out information of the identification codes 26 in a non-contact style.

Figure 13:
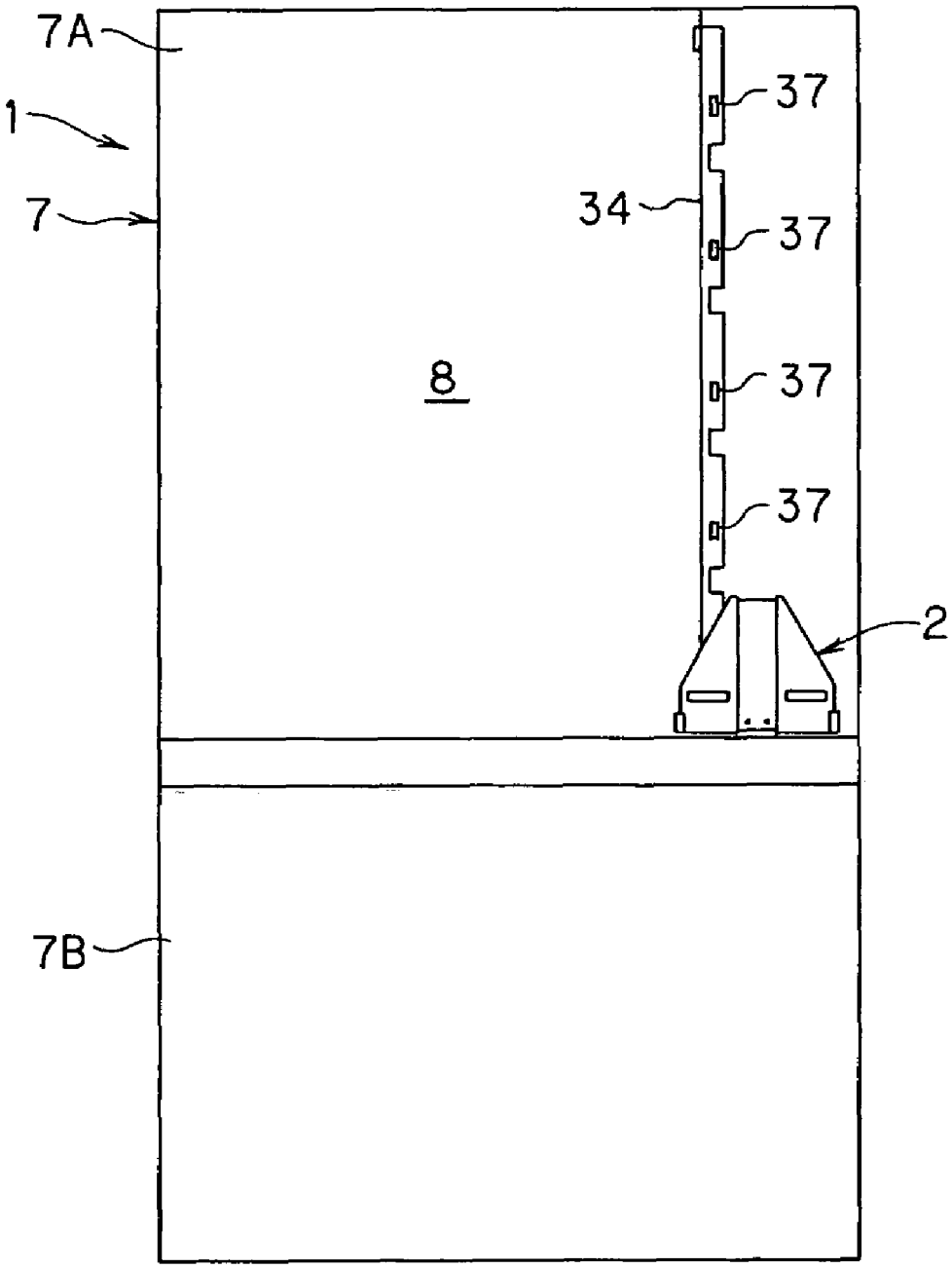
FIG. 13 is a perspective front view showing the relationship between the shelve and a stay in the medicine supply apparatus of FIG. 1.
Figure 14:
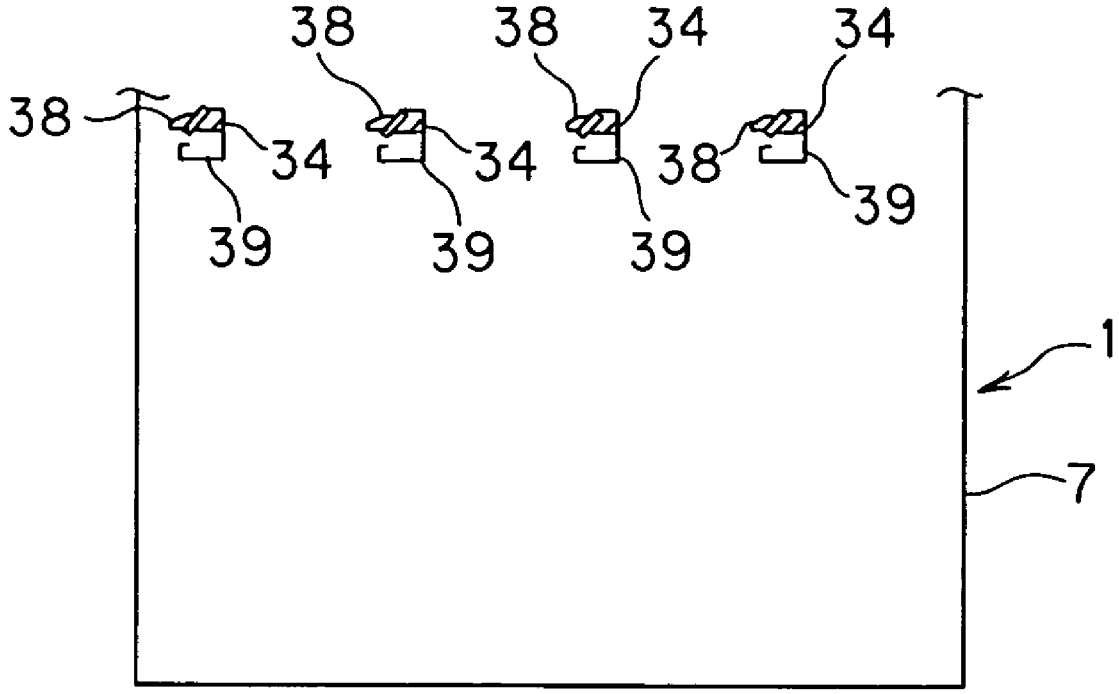
FIG. 14 is a perspective front view showing the positional relationship of the stays of the medicine supply apparatus of FIG. 1.
Figure 15:
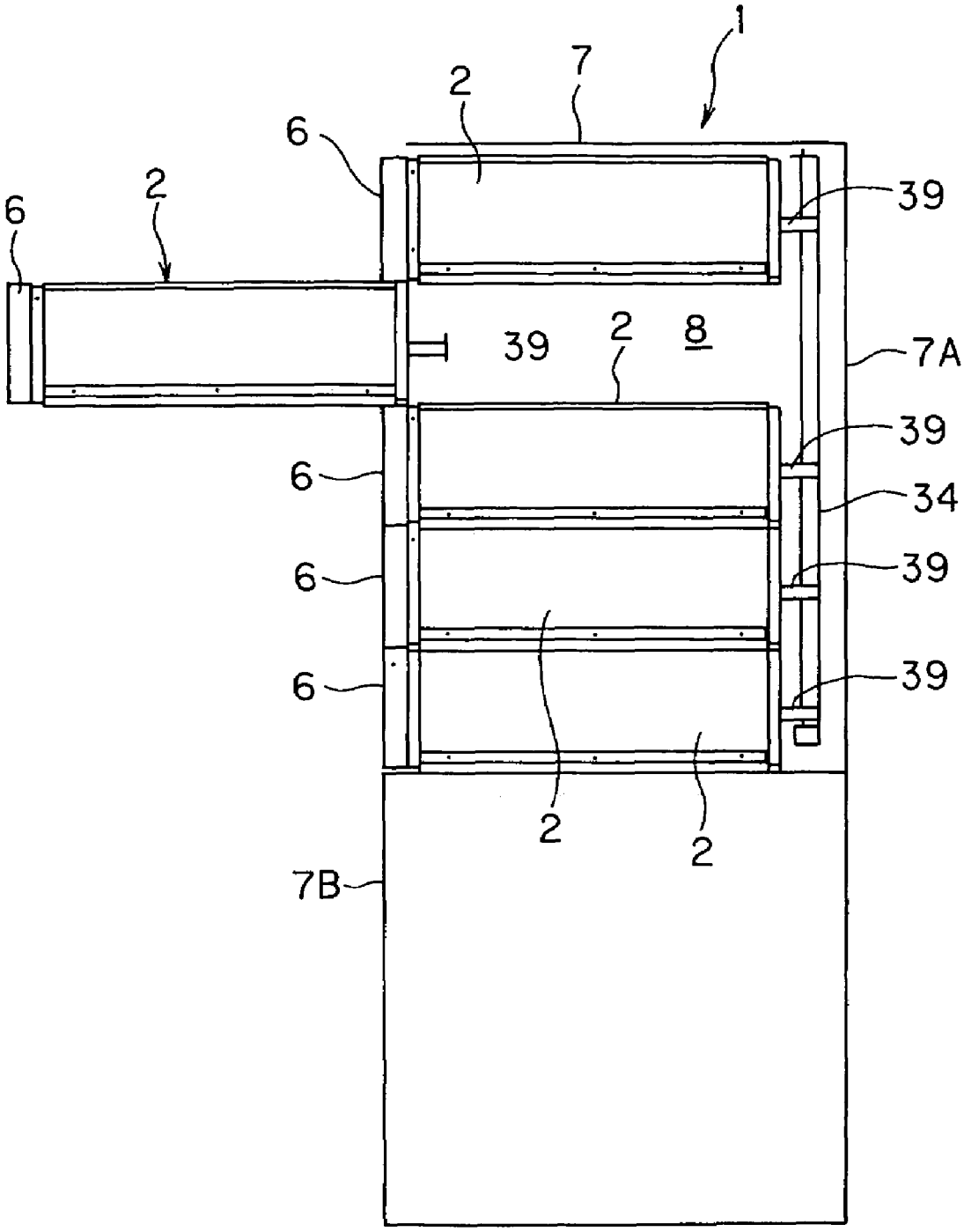
FIG. 15 is a perspective side view showing the relationship between the drawer and the stay in the medicine supply apparatus of FIG. 1.

Here, four stays 34 extending in the up-and-down direction are equipped as regulating means at the rear portion in the case accommodating portion 8 of the upper structure 7A in correspondence with the back sides of the drawers 2 on the columns in the right-and-left direction (FIG. 13 to FIG. 15). The regulating means avoids such a disadvantage that when plural drawers 2 are simultaneously drawn out, the medicine supply apparatus topples over to the front side by the weights of the drawers 2 thus drawn out. Therefore, the regulating means enhances the safety of the medicine supply apparatus.

Furthermore, each stay 34 is disposed so as to be freely rotatable around shafts 36 located at the upper and lower ends. The stay 34 is designed to have an L-shaped section as shown in FIGS. 16 to 21, and has a regulating piece 34A having engaging holes 37 formed at five places thereof in the up-and-down direction, and a release piece 34B extending from the edge portion of the regulating piece 34A vertically.

Figure 16:
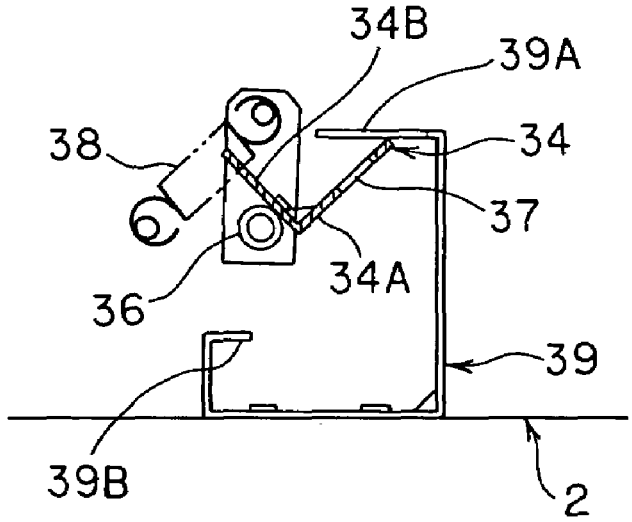
FIG. 16 is a diagram showing the operation of the stay of the medicine supply apparatus of FIG. 1.
Figure 17:
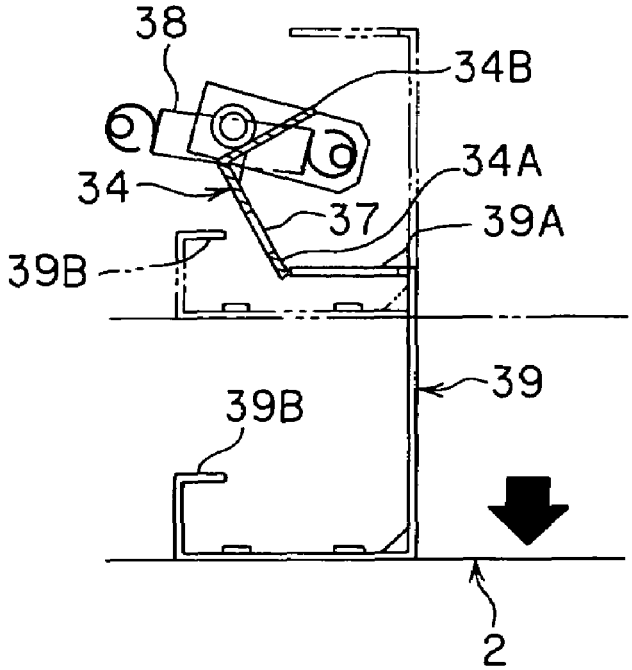
FIG. 17 is a diagram showing the operation of the stay of the medicine supply apparatus of FIG. 1.

A coil spring 38 is fitted to each stay 34, and by restoring force of the coil spring 38, the stay 34 is stably kept to a release state that the respective pieces 34A, 34B are oriented backwardly as shown in FIG. 16 and a regulated state that the regulating piece 34A is oriented forwardly as shown in FIG. 17.

Furthermore, an acting member 39 extending backwardly is secured to the back surface of each drawer 2 so as to project backwardly. The acting member 39 is equipped in conformity with the height of each engaging hole 37 of the stay 34, and has an L-shaped acting piece 39A projecting backwardly and an L-shaped engaging piece 39B located at the front side.

When all the drawers 2 on one column in the up-and-down direction are accommodated in the case accommodating portion 8, the corresponding stay 34 is set to the release state shown in FIG. 16. This state is stably held by the coil springs 38. At this time, the acting piece 39A of the acting member 39 is located behind the regulating piece 34A of the stay 34. When some drawer 2 is drawn out forwardly under the above state, the acting piece 39A presses over the regulating piece 34A and rotates the stay 34 counterclockwise in FIG. 16 (FIG. 17). When the acting member 39 is moved in front of the stay 34, the regulating piece 34A of the stay 34 is forwardly inclined, so that the regulated state under which the release piece 34B is oriented to the right side is set.

Under the regulated state, the engaging pieces 39B of the acting members 39 of the other drawers 2 in the up-and-down direction are inserted and fitted in the engaging holes 37 of the other regulating pieces 34A of the stay 34 (FIG. 18), and thus the other drawers 2 are prohibited from being drawn out. Subsequently, when the drawer 2 thus drawn out is pushed, the acting piece 39A of the acting member 39 finally abuts against the release piece 34B of the stay 34 (FIG. 19), and presses the release piece 34B backwardly, so that the stay 34 is counterclockwise rotated in FIG. 19 (FIG. 20). Accordingly, the regulating pieces 34A are separated from the engaging pieces 39B of the other drawers 2, and thus the engagement between each engaging hole 37 and each engaging piece 39B is released, so that the other drawers 2 are allowed to be drawn out. When the accommodation of the drawer 2 concerned in the case accommodating portion 8 is finished, the stay 34 is returned to the initial release state, and stably held by the coil spring 38 (FIG. 21).

According to this construction, only any one of the drawers arranged on each column in the up-and-down direction is allowed to be drawn out, and thus it is impossible to simultaneously drawn out plural drawers 2. Accordingly, there can be prevented such a disadvantage that plural drawers 2 on one column in the up-and-down direction are simultaneously drawn out and thus the main body 7 topples over to the front side by the weights thereof. Particularly, the drawers on each column in the up-and-down direction can be prohibited from being simultaneously drawn out, and in other words, four drawers at maximum (in the right-and-left direction) can be simultaneously drawn out from the case accommodating portion 8. Accordingly, the minimum usability is secured. Furthermore, the draw-out operation on a column basis is prohibited, and thus the regulating means can be constructed by something like the stay 34 of this embodiment. Therefore, the structure can be simplified.

In the above-described embodiment, at least adjacent drawers 2 may be prohibited from being simultaneously drawn out. However, the drawers which are prohibited from being simultaneously drawn out are not limited to adjacent drawers. For example, every other drawers may be prohibited from being simultaneously drawn out, and any simultaneous draw-out prohibiting style may be adopted insofar as the risk that the medicine supply apparatus topples over due to simultaneous draw-out can be prevented.

Each stay 34 may be further equipped with a lock member 41 projecting forwardly under the release state. A solenoid 42 serving as lock means is secured to the upper structure 7A so as to face the front side of the lock member 41 of each stay 34, and a plunger 42A of the solenoid 42 projects backwardly.

Figure 22:
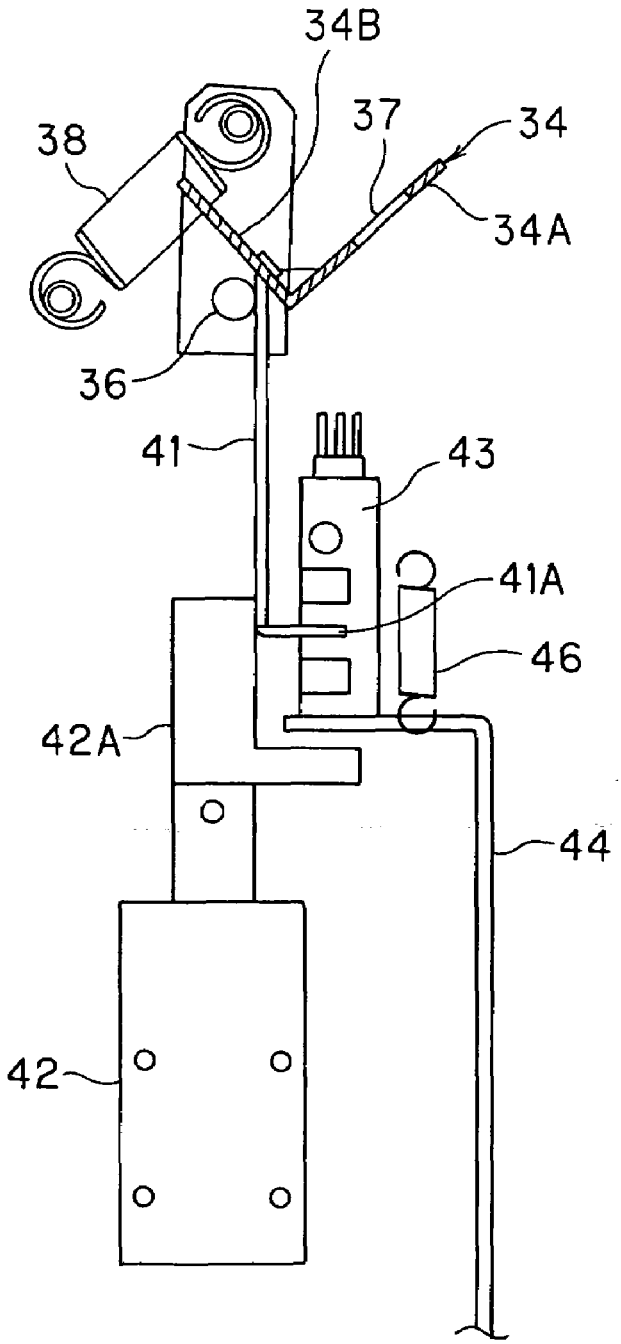
FIG. 22 is a diagram showing the operation of a solenoid of the medicine supply apparatus of FIG. 1.

Under the state that the plunger 42A is kept to project backwardly, the solenoid 42 abuts against the lock member 41 under the release state described above, and prohibits rotation of the lock member 41 (FIG. 22). Accordingly, the stay 34 concerned cannot be rotated, and thus the acting members 39 cannot be moved from the state of FIG. 16, so that all the drawers 2 on the column corresponding to the stay 34 concerned are prohibited from being drawn out. A motor as well as the solenoid of this embodiment may be used as the lock means. Furthermore, in this embodiment, an electric motor-driven type is used as the lock means. However, the present invention is not limited to the electric motor-driven type, and manual lock means such as a mechanical type or the like may be used.

Figure 23:
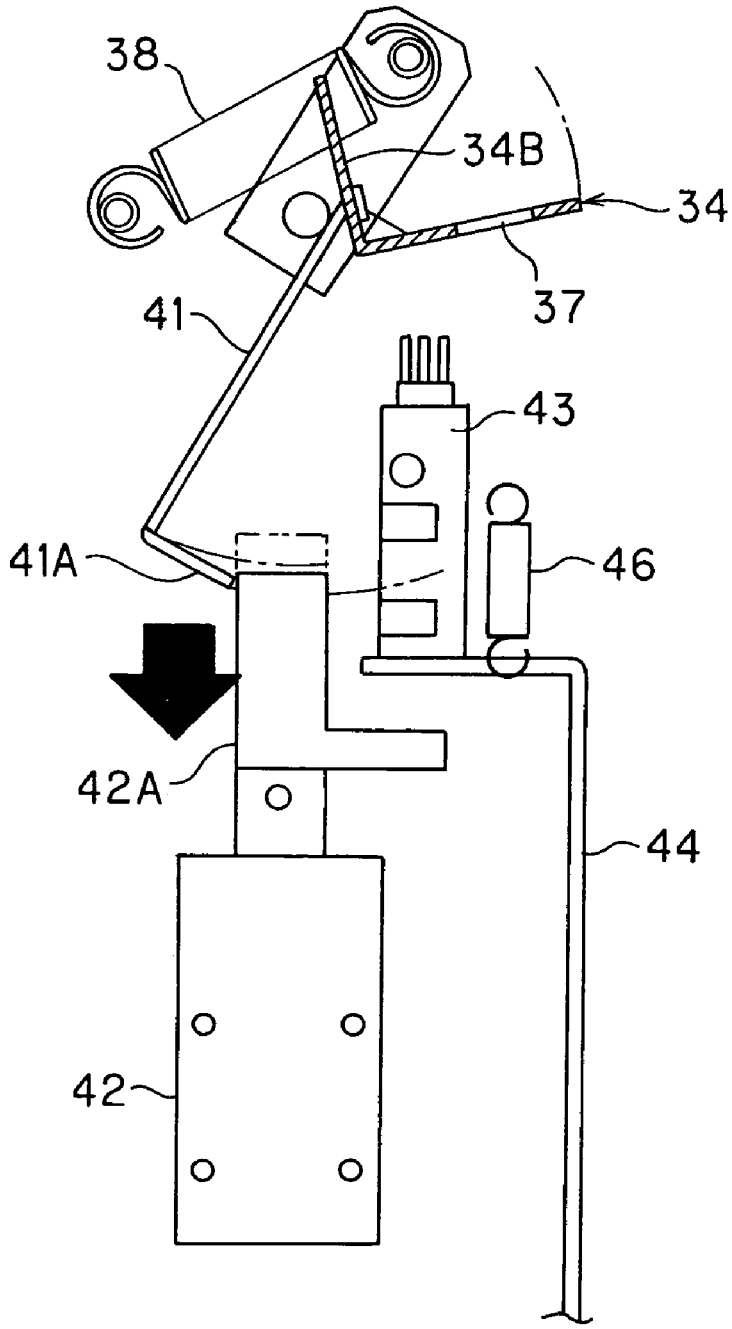
FIG. 23 is a diagram showing the operation of the solenoid of the medicine supply apparatus of FIG. 1.

Under the state that the plunger 42A is sucked in, the stay 34 is allowed to be rotated as shown in FIG. 23, and the lock is released. 43 represents a lock sensor disposed at a position at which the tip 41A of the lock member 41 is located when the stay 34 is set to the release state. When the lock member 41 concerned is detected under the above state, the stay 34 is rotated as shown in FIG. 23 to set the regulated state and then the tip 41A of the lock member 41 is separated from the lock sensor 43, the lock member 41 is not detected. Accordingly, the state of the stay 34 is identifiable.

Figure 24:
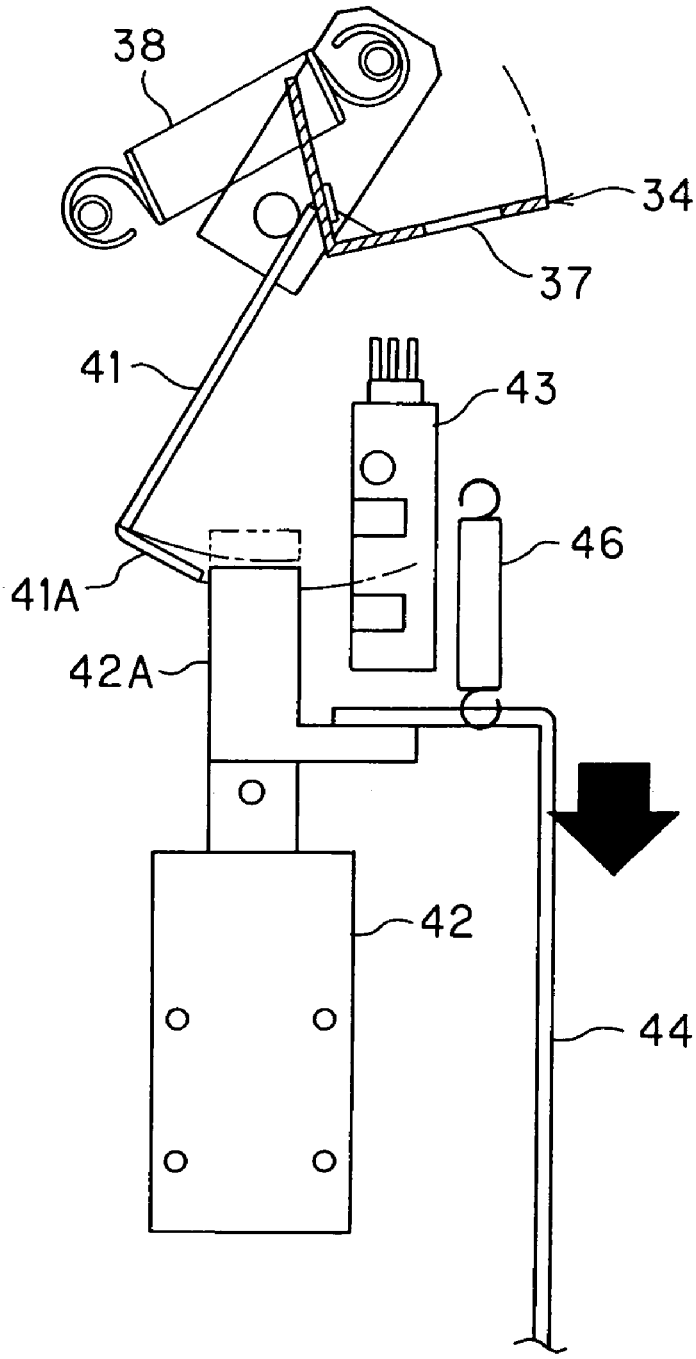
FIG. 24 is a diagram showing the operation of a lock release lever of the medicine supply apparatus of FIG. 1.

Furthermore, 44 represents a lock release bar as manual locking release means, and it is equipped in connection with each solenoid 42. The lock release bar 44 is designed in L-shape, and the rear end thereof is fitted to the plunger 42A. The lock release bar 44 is backwardly urged by a coil spring 46 at all times, and it is separated from the plunger 42A under this state (FIG. 22, FIG. 23). When the lock release bar 44 is pulled, the plunger 42A is sucked into the solenoid 42 side to release the lock of the solenoid 42 (FIG. 24). Accordingly, the lock release of all the drawers 2 on one column in the up-and-down direction can be manually performed. The lock release bar (the lock release means) is not limited to a manual type, but it may be an electric motor-driven type or the like.

In this embodiment, plural drawers 2 are prohibited from being simultaneously drawn out on a vertical column basis. However, this invention is not limited to this style, and plural drawers 2 may be prohibited from being simultaneously drawn out on a horizontal stage basis and also may be locked on a horizontal stage basis. In this case, a lateral stay is equipped in connection with each of the five stages in the up-and-down direction.

According to this embodiment, many drawers are prohibited from being drawn out, the disadvantage that the medicine supply apparatus topples over to the front side by the weight of the drawers can be avoided, and a supplement/exchange work of medicines can be performed with higher safety. Particularly, when the regulating means prohibits simultaneous draw-out of plural drawers every column or every stage, the minimum simultaneous draw-out is allowed, and the structure of the regulating means itself can be simplified with securing usability. When a predetermined number of drawers or all the drawers are prohibited from being simultaneously drawn out by the lock means, an non-allowed access to tablet cases can be prohibited. Therefore, such a risk that different medicines are accommodated can be excluded, and safety in dispensing work can be kept. Furthermore, when the electric motor-driven type is used as the lock means, setting of an access right by using a personal computer can be easily performed.

As described above, the packaging machine 13 (charging apparatus) is accommodated at the lower portion of the lower structure 7B of the main body 7. The structure of the packaging machine 13 will be described in detail later, and the packaging machine 13 is detachably secured to the draw-out rails 47 by screws, and the draw-out rails 47 are secured to the right and left sides of the bottom face in the lower structure 7B as shown in FIG. 3. Accordingly, the packaging machine 13 can be freely drawn out from the inside of the lower structure 7B under the state that the lower panels 4 are opened, and further under the state that the packaging machine is drawn out, the packaging machine can be mounted on or detached from the draw-out rails 47. 48 represents a harness for the packaging machine which is freely detachably connected between the packaging machine 13 and the lower structure 7B through connectors, and it is designed to be long to the extent that the packaging machine 13 is allowed to be drawn out by a sufficient draw-out amount.

Two shutters 53 are juxtaposed with each other at the right and left sides of the upper portion in the lower structure 7B. Each shutter 53 corresponds to the lower side of the chutes located at the upper side of the shutter 53. The shutter 53 located at the right side when the medicine supply apparatus is viewed from the front side thereof corresponds to the chute 32 at the right end and the chute 32 at the left side of the right-end chute 32, and the shutter 53 located at the left side when the medicine supply apparatus is viewed from the front side thereof corresponds to the chute 32 at the left end and the chute 32 at the right side of the let-end chute 32. These shutters 53 are used to temporarily catch medicines falling from each chute 32 to the hopper 54 described later.

The hopper 54 is equipped in the lower structure 7B so as to face the lower portions of the respective shutters 53. The hopper 54 is designed in such a rectangular funnel shape that the upper face thereof is broadly opened and the body thereof is narrowed toward the lower end. The hopper 54 receives medicines which fall from the respective chutes 32 and pass through the shutters 53, and discharges the medicines thus received from the lower end opening 54A.

The right and left sides of the upper end of the hopper 54 are detachably secured through screws to draw-out rails 56 secured at the right and left sides of the upper portion of the lower structure 7B, and also the respective shutters 53 are located at the upper sides of the draw-out rails 56 and detachably secured to the draw-out rails 56 by screws. Accordingly, the hopper 54 and the shutters 53 can be simultaneously freely drawn out forwardly from the inside of the lower structure 7B under the state that the lower panels 4 are opened, and further can be mounted on and detached from the draw-out rails 56 under the state that they are drawn out (FIG. 5). As not shown, a freely detachable harness for each shutter 53 is equipped, and this harness is designed to be sufficiently long to the extent that the draw-out amount of the shutter 53 concerned can be sufficiently allowed.

With the above construction, when maintenance such as exchange of a tablet case 3, cleaning of the chutes 32 constructed by the respective passages 9 and the hopper 54, part exchange of the packaging machine 13, etc. is carried out, these elements are drawn out from the upper structure 7A of the main body 7 or the lower structure 7B thereof and then the detaching work is carried out.

Accordingly, the maintenance workability of the medicine supply apparatus 1 can be remarkably enhanced, and the medicine charging work can be smoothly performed. Particularly, a plurality of tablet cases 3 can be simultaneously drawn out from the upper structure 7A on a drawer basis, and also the accommodating containers 51 thereof are detachably mounted on the tablet cases 3, so that the exchange workability of the accommodating containers 51 of the table cases 3 can be further enhanced.

Furthermore, the shutters 53 are secured so as to be drawn out from the lower structure 7B and detachable therefrom, so that the maintenance workability of the shutters 53 for temporarily receiving medicines falling to the hopper 54 can be enhanced. Particularly, since the shutters 53 and the hopper 54 are secured so that they can be simultaneously drawn out from the lower structure 7B, the workability for the maintenance of the shutters 53 and the hopper 54 can be more remarkably enhanced.

An additive medicine feeder (UTC) 57 is secured at the center of the upper portion in the lower structure 7B so as to be located between both the shutters 53. In this case, the additive medicine feeder 57 are not covered by the lower panels 4 and secured so that it can be independently drawn out to the front side and also freely detached from the lower structure 7B (FIG. 1, FIG. 6). The additive medicine feeder 57 is a feeder for arbitrarily supplying additive medicines, and it intercommunicates with the inside of the hopper 54.

Next, the structure of each shutter 53 will be described with reference to FIGS. 25 to 27. The shutter 53 is designed to be elongated in the depth direction of the lower structure 7B and substantially symmetric in the right-and-left direction as a whole, and it comprises a rectangular funnel-shaped main body 62 having right and left slope walls 61A and 61B which are separated from each other while being inclined from the lower side to the upper side so that the upper face of the main body 62 is broadly opened, and a pair of opening/closing plates 63A and 63B for opening/closing a lower end opening 62A which is formed to be narrowed between the lower ends of the slope walls 61A and 61B of the main body 62.

Each opening/closing plate 63A, 63B is operated by a solenoid 64, a coil spring 68 and a link mechanism 66 which are equipped at the rear portion of the opening/closing plate 63A, 63B. As shown in FIG. 26, the lower ends of the respective opening/closing plates 63A and 63B mutually abut against each other substantially continuously from the lower ends of the right and left slope walls 61A and 61B, and driven to a closed state under which the lower end opening 62A of the main body 62 is closed and an opened state under which the opening/closing plate 63A is clockwise rotated as shown in FIG. 27 while the opening/closing plate 63B is counterclockwise rotated, so that the lower ends of the opening/closing plates 63A and 63B are mutually separated from each other and thus the lower end opening 62A is opened.

A curtain 67 serving as a buffer member is secured in each shutter 53. The curtain 67 is formed of thin cloth, rubber or synthetic resin having flexibility, and it can absorb kinetic energy of medicines which fall from the chutes 32, impinge against the right and left slope walls 61A, 61B and rebound therefrom. The curtain 67 is suspended from the center of the upper portion in the main body 62 between the slope walls 61A and 61B so as to face the slope walls 61A and 61B), and the lower end thereof extends further downwardly as compared with the lower end opening 62A of the main body 62, and extends to the position at which the lower end of the curtain 67 is pinched between the opening/closing plates 63A and 63B under the state that the opening/closing plates 63A and 63B are closed.

According to this structure, the kinetic energy of medicines which fall into the shutters 53 and rebound therefrom are absorbed by the curtain 67, and the medicines quickly gather from the lower end opening 62A onto the opening/closing plates 63A and 63B and get still there. Particularly, the curtain 67 extends from the upper portion of the shutter 53 to the lower end portion thereof (while facing the slope walls 61A and 61B), so that the rebounding medicines are liable to abut against the curtain 67 and the impact (the kinetic energy of the medicines) absorbing action is further excellent. Therefore, the time in which the medicines get still is further shortened. Furthermore, the curtain 67 is pinched between the opening/closing plates 63A and 63B, and thus noise occurring when the lower ends of the opening/closing plates 63A and 63B abut against each other is absorbed. Accordingly, it is possible to surely and quickly drop the medicines from the shutter for temporarily receiving the medicines to the hopper.

In this embodiment, the lower end of the curtain 67 is pinched by the opening/closing plates 63A and 63B of he shutter 53. However, the end of the curtain 67 may be located in a free position just above the opening/closing plates 63A, 63B.

Next, the construction of the packaging machine 13 will be described with reference to FIG. 28. 71 represents a roll around which heat-adhesive packaging paper 72 (constructing a container) is wound, 73 represents a printer, 74 represents a nozzle secured to the lower end opening 54A of the hopper 54, 76 represents a heat seal head formed of silicon rubber, 77 represents a roller for feeding the packaging paper 72 drawn out from the roll 71, 79 represents a cutter for cutting the packaging paper 72, and 81 represents a conveyor for feeding partitioned and cut-out packaging paper 72 to a take-out port 82 equipped to the lower panel 4, which are successively disposed along the feeding passage of the packaging paper 72. 83 represents a motor for operating the heat seal head 74, 78 represents a motor for driving the roller 77, and 84 represents a motor of the conveyor 81.

The packaging paper 72 wound around the roll 71 is opened at the upper surface thereof, and two-folded at the lower end thereof to form a substantially V-shaped section. The packaging paper 72 is drawn out from the roll 71 in a slant direction to the lower right side by a roller 77, etc., and then the surface thereof is printed as described later. Subsequently, medicines discharged from the nozzle 74 are put into the packaging paper 72, and partitioned on a pack basis by heat-adhesion of the heat seal head 76. The packaging paper 72 which is partitioned and packaged is cut by the cutter 79, and then fed to the take-out port 82 at the upper left side by the conveyor 81.

Figure 29:
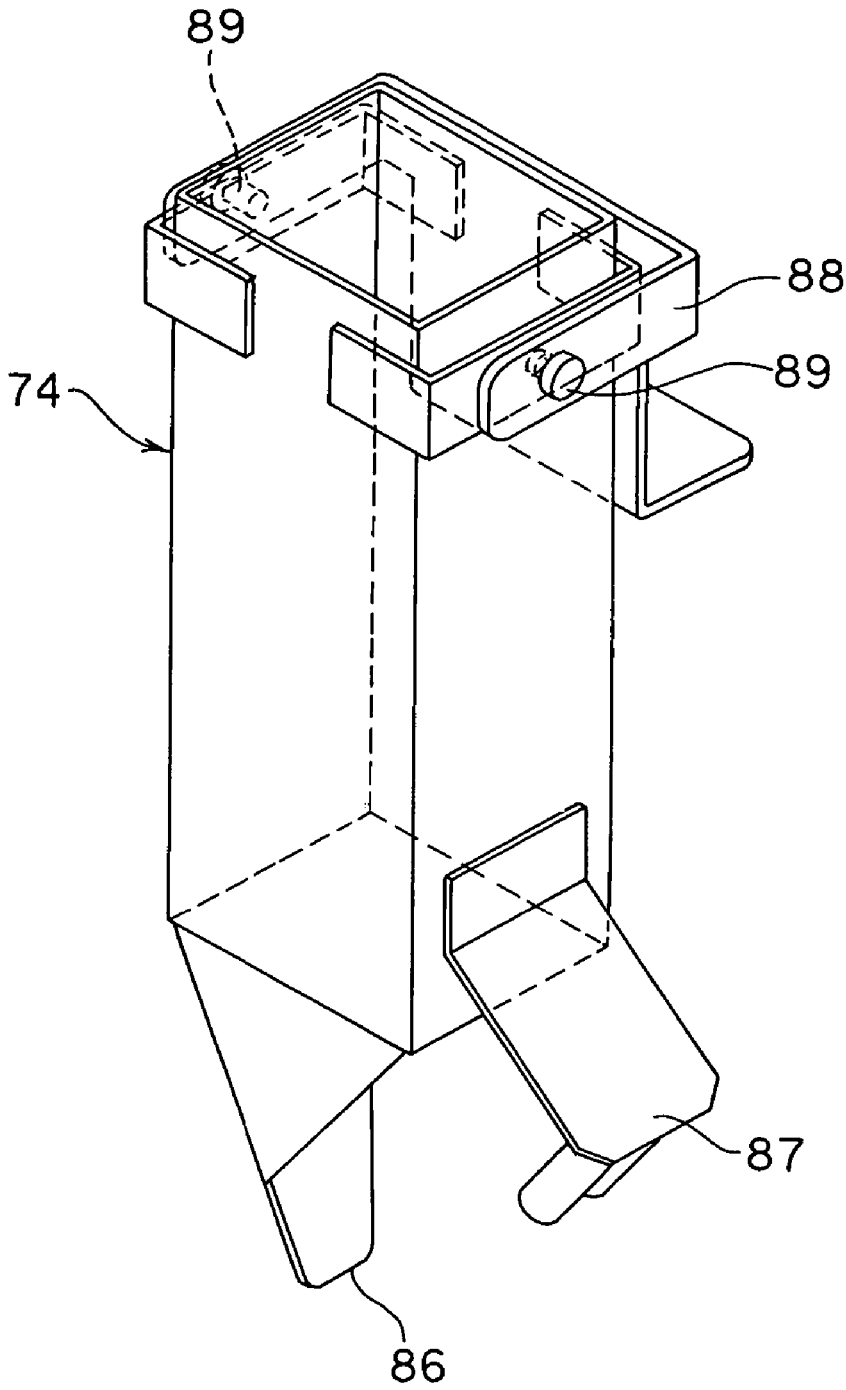
FIG. 29 is a perspective view showing a nozzle of the medicine supply apparatus of FIG. 1.

Here, the nozzle 74 is designed in a rectangular cylindrical shape which is opened at the upper and lower portion thereof as shown in FIG. 29. An insertion guide piece 86 to be inserted from the opening of the upper face of the packaging paper 72 into the packaging paper 72 is formed at the printer 73 side of the lower end of the nozzle 74 so as to project from the lower end of the nozzle 74, and a paper guide piece 87 for closing the opening of the upper face of the packaging paper 72 is formed at the opposite side of the lower end of the nozzle 74 to the insertion guide piece 86. The opening of the upper end of the nozzle 74 faces the opening 54A of the lower end of the hopper 54. Accordingly, medicines received by the hopper 54 are put into the nozzle 74, and then put into the packaging paper 72 guided by the insertion guide piece 86.

The nozzle 74 is secured to the hopper 54 by rotational shafts 89 of a holding member 88 so as to be freely swingable in a direction (front-and-rear direction) perpendicular to the travel direction (indicated by an arrow in FIG. 28) of the packaging paper 72. Accordingly, even when the positions of the hopper 54 and the nozzle 74 are not strictly coincident with the position of the packaging paper 72 of the packaging machine 13, the nozzle 74 is swung by the amount corresponding to the positional displacement, whereby the lower-end port of the nozzle 74 can be made coincident with the position of the packaging paper 72 with no trouble. Accordingly, even in such a case, the insertion guide piece 86 of the nozzle 74 can be inserted into the packaging paper 72 to put medicines into the packaging paper 72 without unnecessarily spreading the opening of the upper face of the packaging paper 72, and also the workability when the hopper 54 and the nozzle 74 are installed can be enhanced.

Figure 30:
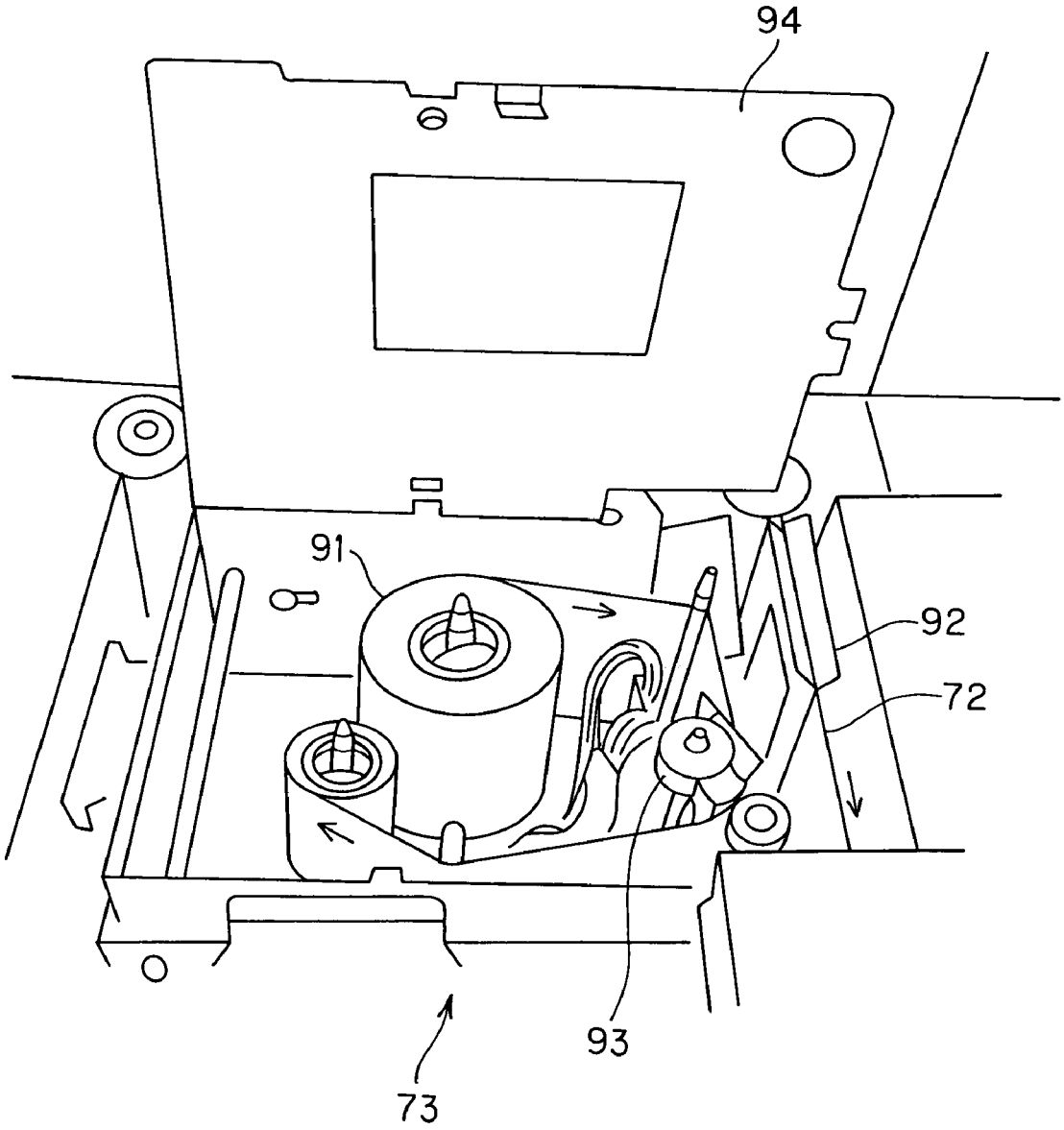
FIG. 30 is a perspective view showing a printer of the medicine supply apparatus of FIG. 1.

Next, the printer 73 will be described. The printer 73 is a thermal transfer type printer using an ink ribbon. As shown in FIG. 30, the packaging paper 72 is pressed against a color ink ribbon 91 by a press plate 92, and predetermined printing is carried out on the surface of the packaging paper 72 by a thermal transfer head 93. 94 represents an open/close lid of the printer 73. The travel directions of the color ink ribbon 91 and the packaging paper 72 are indicated by arrows in FIG. 30.

Figure 31:
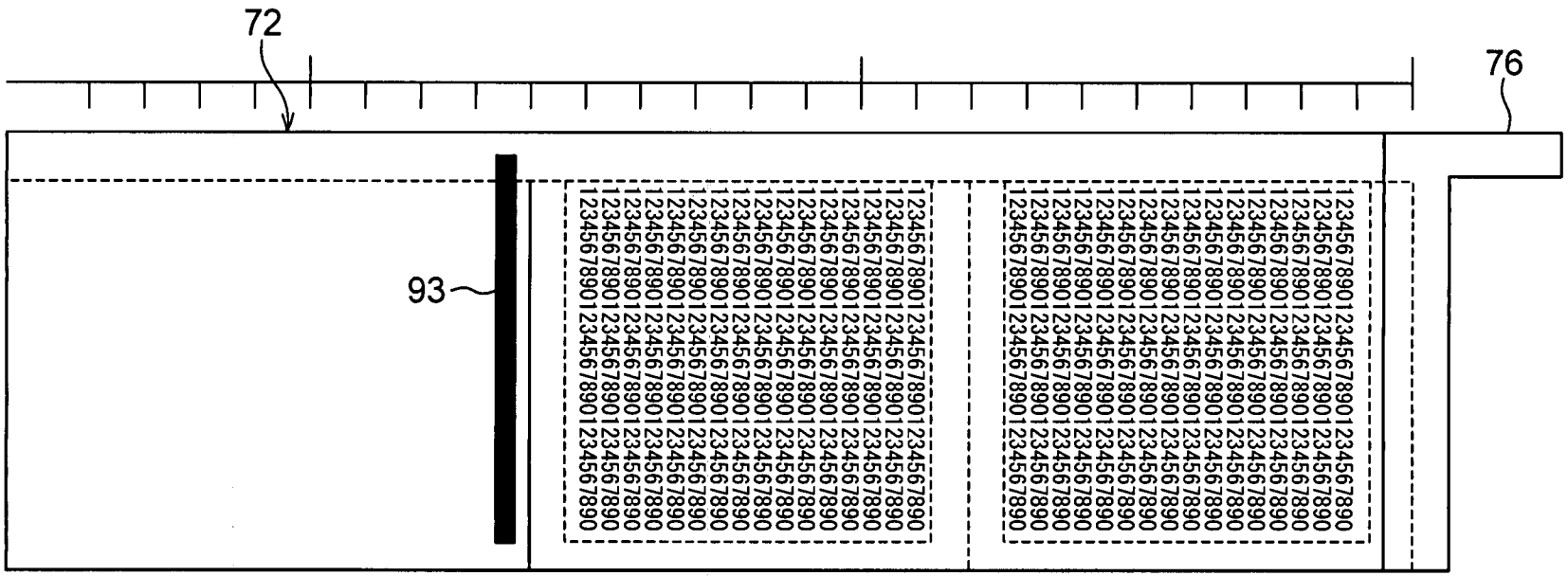
FIG. 31 is a diagram showing the positional relationship between a printer head and a heat seal head to packaging paper in the medicine supply apparatus of FIG. 1.
Figure 32:
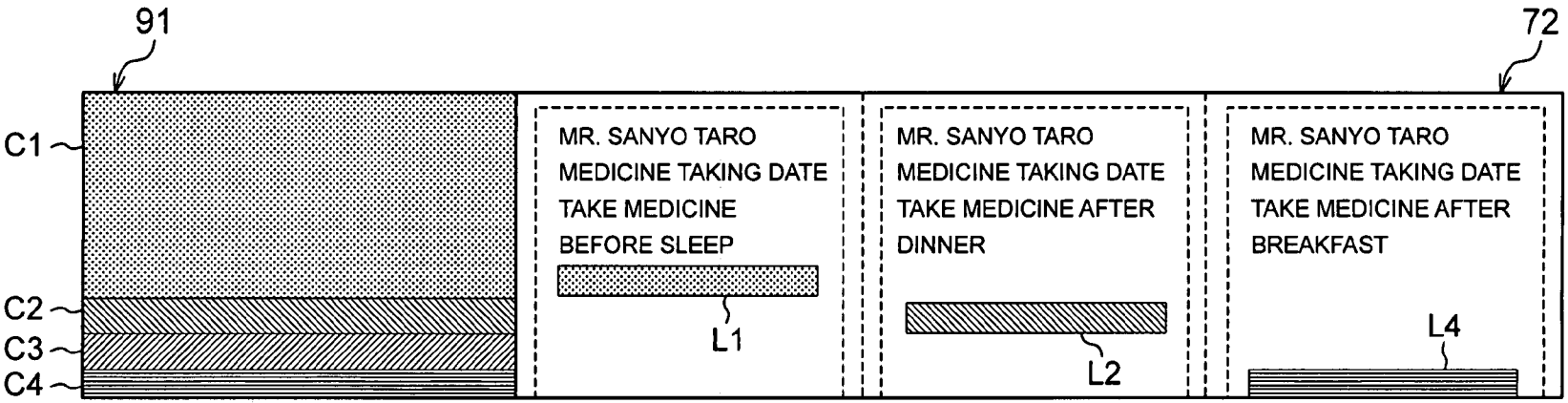
FIG. 32 is a diagram showing a print result to the packaging paper in the medicine supply apparatus of FIG. 1.

FIG. 31 shows the positional relationship between the printer head 93 and the heat seal head 76 with respect to the packaging paper 72, and shows print example printed therebetween. In this embodiment, the color ink ribbon 91 contains different four kinds of color zones in the width direction as shown in FIG. 32. The broadest zone C1 for printing is black color, for example, and a blue zone C2, a red zone C3 and finally a yellow zone C4 are equipped in this order.

Figure 33:
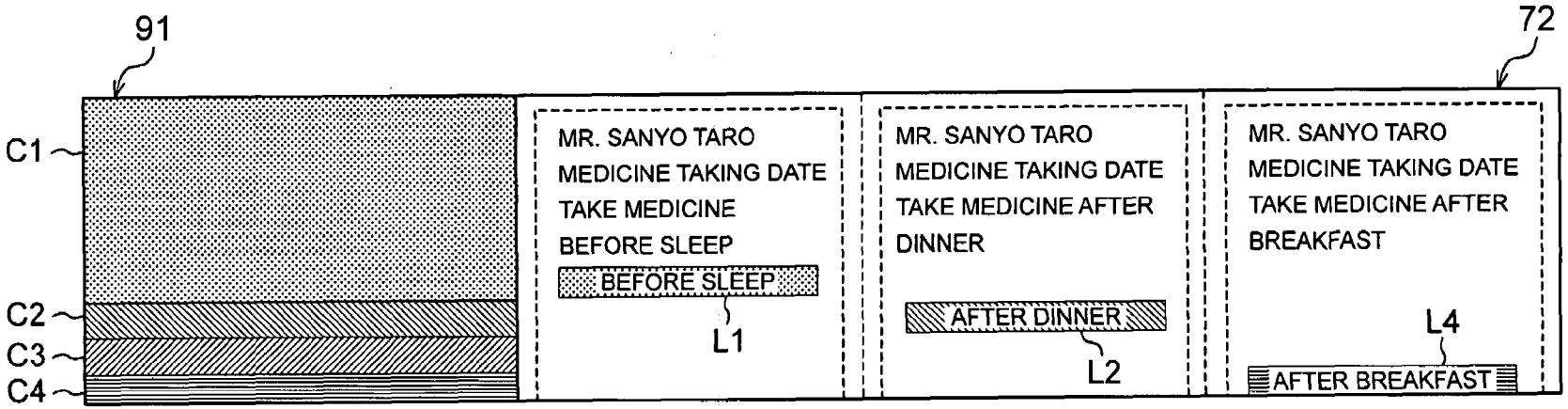
FIG. 33 is a diagram showing another example of the print result to packaging paper in the medicine supply apparatus of FIG. 1.

The printer 73 thus constructed prints names, medicine taking date, medicine taking time zone, etc. with block in the zone C1, and also the printer 73 prints a black line L1 on a package to be taken before sleeping, a blue line L2 on a package to be taken after dinner, and a yellow line L4 on a package to be taken after breakfast so that medicine taking time zones are discriminatively indicated with different colors. Accordingly, the medicine taking time zone can be easily identified, and occurrence of erroneous medicine taking can be effectively avoided. As shown in FIG. 33, the respective medicine taking time zones may be printed with characters on the respective lines L1, L2, L3.

Figure 34:
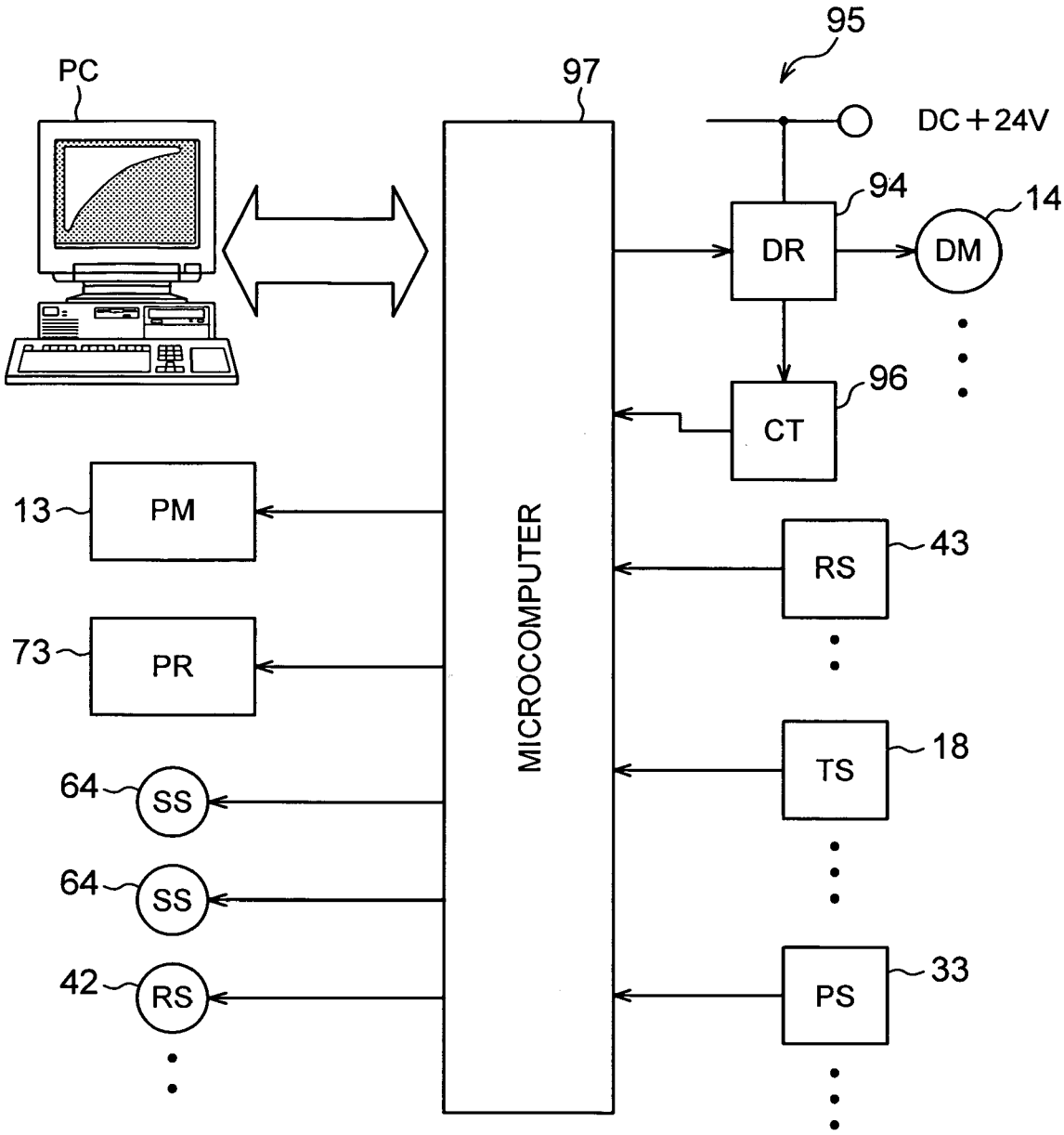
FIG. 34 is a block diagram showing an electrical circuit of a controller of the medicine supply apparatus of FIG. 1.

Next, FIG. 34 is a block diagram showing an electrical circuit of a controller 95 for the medicine supply apparatus 1. The controller 95 comprises a general purpose microcomputer 97 constituting control means, and the drum motor 14 of each table case 3, the packaging machine 13, the printer 73, the shutter solenoid 64 and each solenoid 42 are connected to the output of the microcomputer 97 through a driver circuit 94. The microcomputer 97 controls the driver circuit 94 to apply a DC 24V voltage to each drum motor 14, whereby the drum motors 14 are forwardly and reversely rotated.

Furthermore, an output of a current transformer for detecting current flowing through each drum motor 14 and outputs of each lock sensor 43, each medicine detecting sensor 18 and each identifying sensor 33 are connected to inputs of a microcomputer 97. Furthermore, the microcomputer 97 is connected to the personal computer PC so that the data communication can be performed therebetween.

The operation of the medicine supply apparatus 1 thus constructed will be described. It is assumed that each shutter 53 is closed when the power source is turned on. It is assumed that the drawers 2 on which the tablet cases 3 having prescribed medicines accommodated therein are mounted are installed in the case accommodating portion 8 of the upper structure 7A as described above.

When the power source of the medicine supply apparatus 1 is turned on, the microcomputer 97 of the controller 95 reads an identification code of each tablet case 3 of each of the drawers located at the right and left ends of the case accommodating portion 8 of the upper structure 7A by using the identifying sensors 33. Accordingly, data on the type of medicines accommodated in each table case 3 is stored together with the position of the tablet case 3 concerned, and the data is transmitted to the personal computer PC.

The microcomputer 97 has a data base for the types of medicines in respective tablet cases 3 accommodated in the case accommodating portion 8 and the positions of the tablet cases 3 concerned, and the data base concerned is also transmitted to the personal computer PC. The identification codes read out by the identifying sensors 33 are also added to the data base concerned.

First, the dispensing operation will be described. When a worker inputs prescription data from the personal computer on the basis of a medical prescription indicated by a doctor, the microcomputer 97 of the medicine supply apparatus 1 specifies a tablet case 3 containing the indicated medicines from the data base on the basis of the prescription data concerned, and forwardly rotates the corresponding drum motor 14 by the driver 94 to rotate (forwardly rotate) the discharge drum 23, so that the medicines in the longitudinal groove 24 are discharged to the discharge port 21 one by one.

At this time, the microcomputer 97 receives a medicine detection signal from the medicine detecting sensor 18 to count the medicines thus discharged. At the stage that a predetermined amount (number) of medicines are discharged, the drum motor 14 is stopped. The medicines thus discharged are put from the discharge chute 19 into the chute 32 constructed by the passage 9, and temporarily caught by the shutter 53.

The microcomputer 97 supplies current to the shutter solenoid 64 to open the opening/closing plates 63A and 63B (FIG. 27) as described above and the medicines fall into the hopper 54. Then, the medicines are put through the nozzle 74 into the packaging paper 72, packaged by the packaging machine 13 as described above, and then transferred from the take-out port 82 to the outside. At this time, at the time point when the medicines fall from the shutter 53 to the hopper 54, the next medicine discharging operation is carried out. Therefore, the microcomputer 97 shortens the time required for the packaging. Furthermore, the printing operation for medicines to be packaged is carried out by the printer 73 before the medicines concerned are put into the packaging paper.

Here, in this embodiment, 320 tablet cases 3 are accommodated in the case accommodating portion 8. Accordingly, 320 types of medicines at maximum can be supplied and packaged. However, when the types of medicines to be treated exceed the capacity of the case accommodating portion 8, accommodating containers 5 (at the side wall side of the case accommodating portion 8) of tablet cases 3 of each of the drawers 2 located at the right and left ends of the case accommodating portion 8 are exchanged by accommodating containers 51 containing necessary types of medicines. The identification codes of the accommodating containers thus exchanged are read out by the identifying sensors 33, and input to the microcomputer 97. The data concerning the new medicines thus read out are added to the data base.

At this time, when the case accommodating portion 8 contains no tablet case 3 for one or plural types of medicines to be put into the packaging paper, the microcomputer 97 transmits data to the personal computer PC to indicate an exchange of a tablet case 3 on the screen of the personal computer PC. At this time, the microcomputer 97 transmits data to the personal computer PC to display on the screen the position (address) of the accommodating container 51 of a table case 3 which may be detached. Accordingly, in a case where plural types of medicines are put into one package, there can be avoided such a disadvantage that when an accommodating container 51 containing one type of medicines to be put into the package concerned is newly installed because it does not exist in the case accommodating portion 8, an accommodating container 51 containing another type of medicines to be put into the package concerned is detached from the case accommodating portion 8 by mistake. Subsequently, the microcomputer 97 controls the driver 94 to carry out an abnormality detecting operation of periodically rotating the drum motor 14 in the reverse direction for a predetermined short time (for example, 10 ms), and then rotate the drum motor 14 in the forward direction for the same time. The predetermined time of the reverse/forward rotation in the abnormality detecting operation is set to be sufficiently shorter than the time interval (medicine discharging time interval) at which the longitudinal groove 24 is coincident with the discharge port 21 by the rotation of the discharge drum 23.

The microcomputer 97 reads the current value flowing in the drum motor 14 under the abnormality detecting operation through the current transformer 96. If no current flows in the drum motor 14, the microcomputer 97 judges that the coil of the drum motor 14 is broken, and executes an alarm operation. The data of the alarm is transmitted to the personal computer PC and displayed on the screen. The abnormality detecting operation is successively carried out on the drum motors 14 of all the tablet cases 3. In this case, the time for the reverse/forward rotation in the abnormality detecting operation is set to be sufficiently shorter than the medicine discharging interval, and thus no medicine is discharged.

Particularly, the drum motor 14 is first reversely rotated, and thus even when a medicine is about to fall from the longitudinal groove 24 to the discharge port 21 in the previous discharging operation (the forward rotation of the drum motor 14), there occurs no such a disadvantage that the medicine is erroneously discharged to the discharge port 21.

On the basis of an instruction data from the personal computer PC, the microcomputer 97 supplies current to the solenoids corresponding to the drawers 2 of one column to all the columns which are specified by an input operation to the personal computer PC concerned, and the plungers 42A is projected backwardly to set the lock state. Accordingly, it is impossible to draw out all the drawers 2 of the column (containing all the columns) corresponding to the solenoid 42 as described above (FIG. 22). The lock release is carried out by supplying the solenoid 42 with current in the reverse direction on the basis of an input operation to the personal computer PC. At this time, the plunger 42 is sucked in as described above (FIG. 23).

In this case, an operation access right for the lock and the lock release is set to the personal computer PC by a user (password or the like). Accordingly, there can be avoided such a disadvantage that a shelve 2 is carelessly drawn out and different medicines are accommodated in a tablet case 3.

Here, the microcomputer 97 judges on the basis of the lock sensor 43 whether the stay 34 is under the release state or regulated state as described above, and carries out no lock operation on the solenoid 42 corresponding to a column on which some drawer 2 is drawn out and the stay 34 is set to the regulated state. Accordingly, there can be avoided such a disadvantage that the lock member 41 of the stay 34 under the regulated state is hooked to the plunger 42A of the solenoid 42 and thus the stay 34 is not rotatable. As described above, the lock state of the solenoid 42 may be manually released by pulling the lock release lever 44. It is required to limit persons who know the lock release lever 44, and the lock release lever 44 may be located at a normally unknown position, for example, it may be operated from only the lower structure 7B side. Accordingly, even when the solenoid 42 has a breakdown and thus the lock state cannot be released, there is no problem in the drawing operation of the drawers 2.

The microcomputer 97 integrates the operation time of each drum motor 14 in the medicine discharging/packaging operation described above. Furthermore, the microcomputer 97 integrates the operation frequency of each shutter solenoid 64 and the solenoid 42 and the operation frequency of each of the heat seal head 76 of the packaging machine 13, the thermal transfer head 93 of the printer 73, etc. In addition, durable limited values of these consumable parts are input and set in the microcomputer 97.

When the operating times or the operation frequencies of these consumable parts approach to or reach the corresponding durable limited values, the microcomputer 97 transmits breakdown predicting data to the personal computer PC so that it is indicated on the screen of the personal computer PC that the risk of the breakdown of the consumable part concerned is high, whereby a user can beforehand exchange a drum motor 14, a shutter solenoid 64, a solenoid 42, a heat seal head 76 or a thermal transfer head 93 which approaches to or reaches the corresponding durable limit, and thus avoid such a situation that supply of medicines is delayed because the consumable part has a breakdown.

Figure 35:
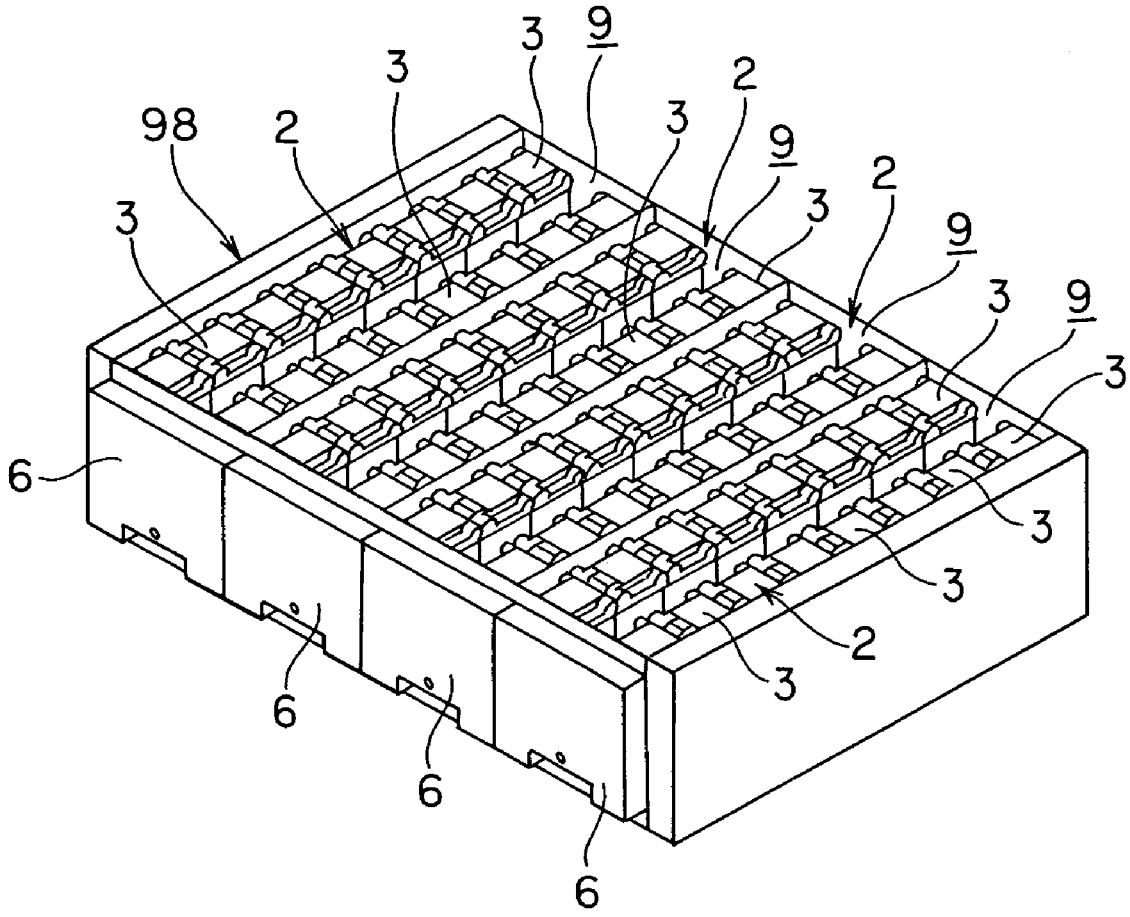
FIG. 35 is a perspective view showing an extension unit of the medicine supply apparatus of FIG. 1.

Here, FIG. 35 shows an additional unit 98 which can secured to the medicine supply apparatus 1. For example, in the case of a large-scale hospital or the like, 320 tablet cases 3 may be insufficient under the state of FIG. 1. Therefore, in such a case, the top plate 1A of the upper structure 7A is detached, and the additional unit 98 is fixedly joined to the upper opening portion of the upper structure 7A (the top plate 1A is secured to the upper face of the additional unit 98). The additional unit 98 is equipped with plural drawers (for example, four) of one stage in the right-and-left direction so that the drawers are freely drawn out. Accordingly, the number of the tablet cases 3 is increased by 64.

The lower end of the passage 9 of each drawer 2 of the additional unit is matched with the upper end of the passage 9 of each drawer 2 at the upper end of the case accommodating portion 8 located below the additional unit to thereby form continuous chutes 32. The drum motor 14 and the medicine detecting sensor 18 of each tablet case 3 of the additional unit 98 are also connected to the microcomputer 97, and the same discharging operation is carried out.

Figure 36:
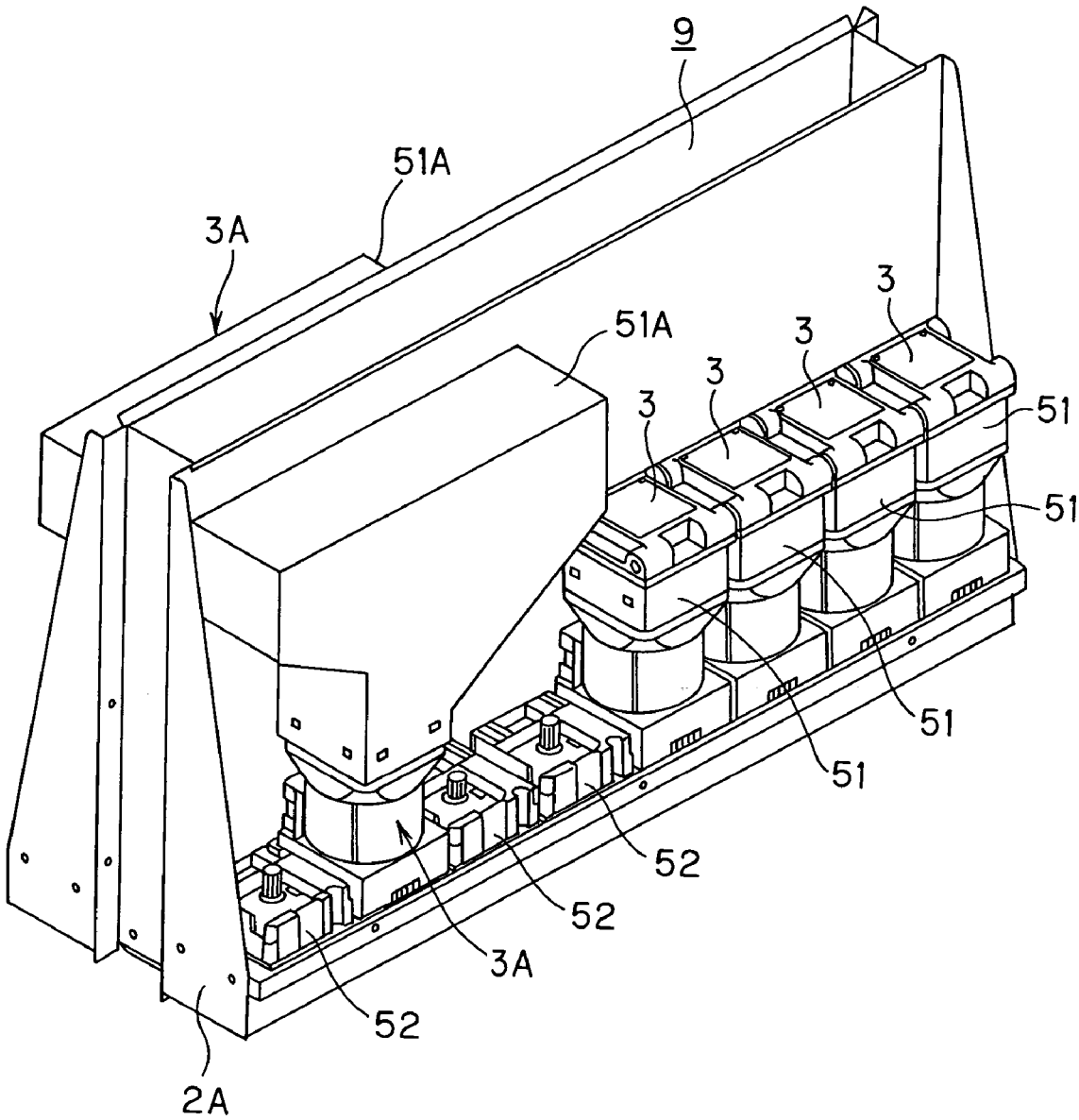
FIG. 36 is a perspective view showing another example the drawer of the medicine supply apparatus of FIG. 1.
Figure 37:
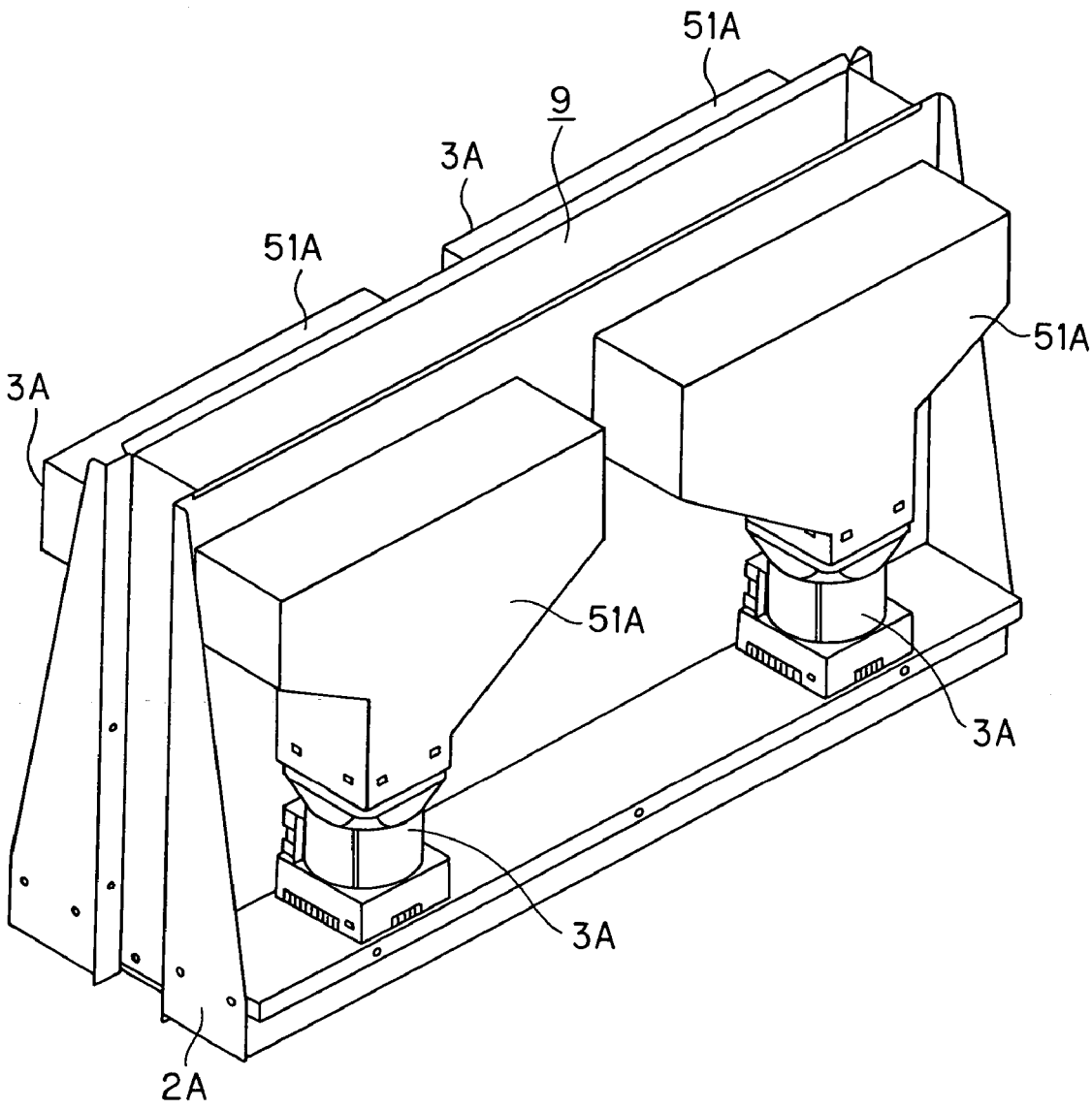
FIG. 37 is a perspective view showing another embodiment of the drawer of the medicine supply apparatus shown in FIG. 1.

Here, a drawer 2A which is twice as high as the drawers 2 described above may be mounted in the case accommodating portion 8 so as to be freely drawn out as shown in FIGS. 36 and 37. In this case, a tablet case 3A having a large-capacity accommodating container 51A as shown in FIGS. 36 and 37 is mounted on the shelve 2A. FIG. 36 shows a case where normal tablet cases 3 and a large-capacity tablet case 3A are mounted in combination, and FIG. 37 shows a case where only large-capacity tablet cases 3A are mounted. In both the cases, the harness 28 described above is connected to the shelve 2A by a connector.

In addition to tablets, capsules, etc., medicines such as half tablets achieved by cutting tablets into halves are treated In the medicine supply apparatus as described above. Furthermore, there is a medicine which is used by only a small amount or another medicine which is used by a large amount at a time. Still furthermore, the maximum number of tablet cases which can be accommodated are not necessarily required to be used in some hospitals or medical pharmacies.

In consideration of such a situation, the usability of the medicine supply apparatus described above is expected to be enhanced.

Figure 38:
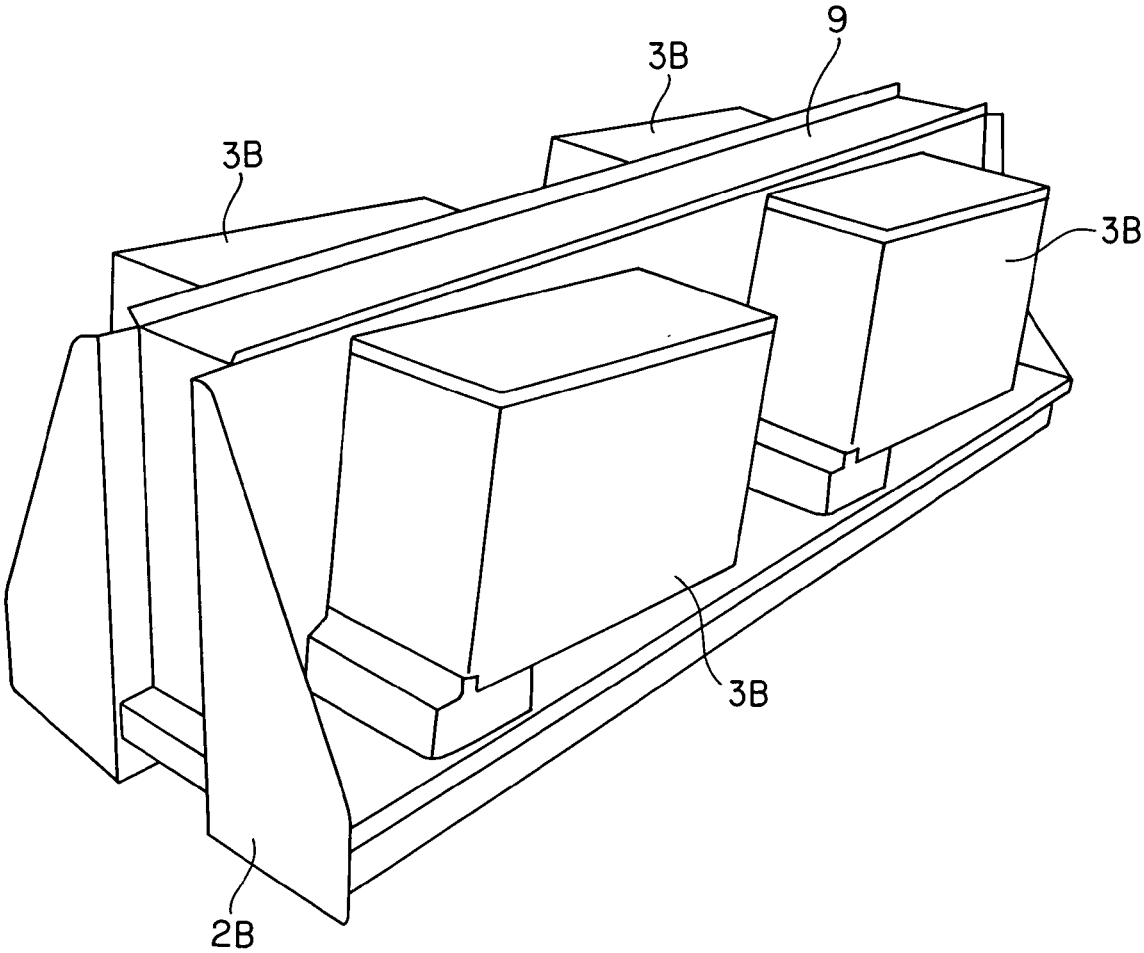
FIG. 38 is a perspective view showing another embodiment of the drawer of the medicine supply apparatus of FIG. 1.
Figure 39:
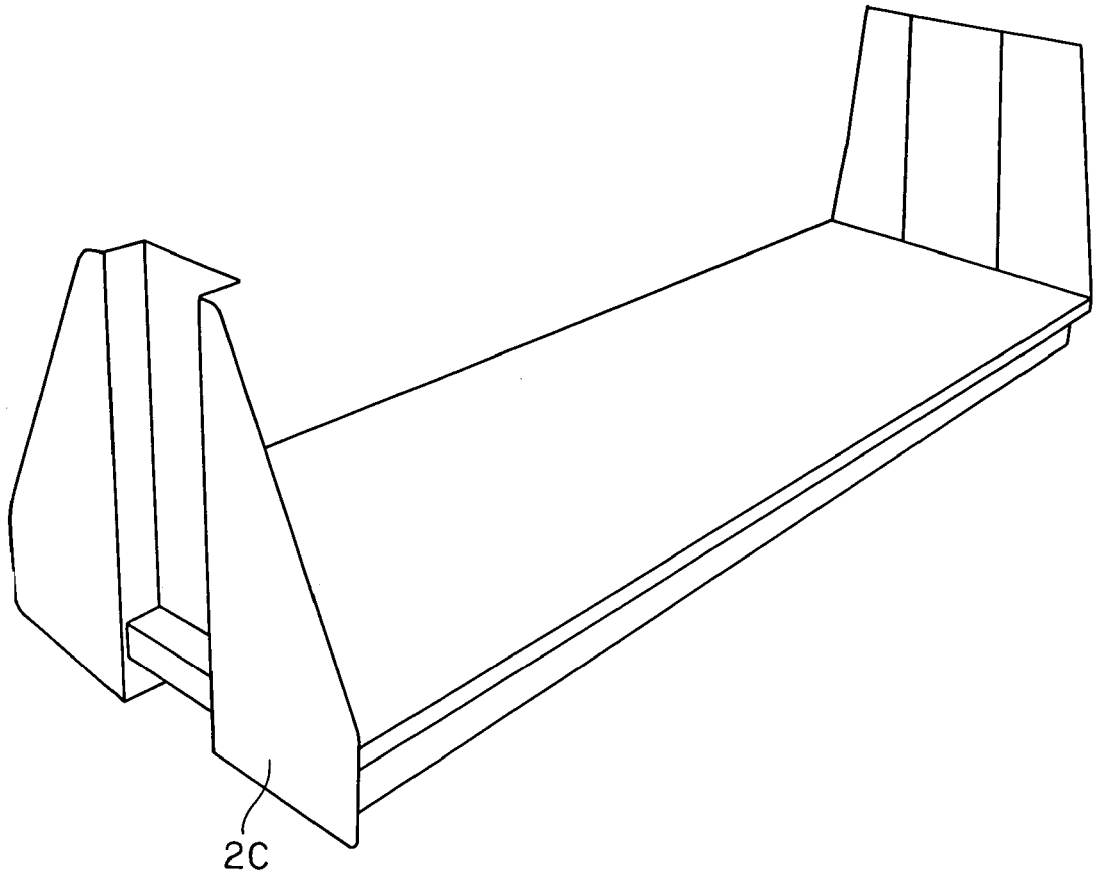
FIG. 39 is a perspective view showing another embodiment of the drawer of the medicine supply apparatus of FIG. 1.

In order to implement this expectation, the medical supply apparatus of this embodiment may be designed so that a drawer 2B having tablet cases 3B for half tablets (tablets cut into halves) as shown in FIG. 38 is mounted in the case accommodating portion 8 so as to be freely drawn out. The harness 28 described above is also connected to this drawer 2B through a connector. Furthermore, a drawer 2C on which no tablet case is mounted as shown in FIG. 39 may be mounted in the case accommodating portion 8 so as to be freely drawn out. Medicines packed by cardboards, etc. are put on the drawer 2C, however, no harness is connected thereto.

As described above, various drawers such as the drawers 2A, 2B on which different tablets are mounted or the drawer 2C to which no power source is connected can be mounted in the case accommodating portion 8 so as to be freely drawn out, so that the usability of the medicine supply apparatus 1 can be remarkably enhanced.

Furthermore, plural kinds of drawers on which different types of tablet cases (which are different in size or shape of the tablet cases or different in the type of accommodated medicines, or the lie) are mounted independently or in combination may be mounted in the case accommodating portion of the medicine supply apparatus so as to be freely drawn out. Still furthermore, drawers on which tablet cases can be mounted and drawers on which no table case is mounted (articles other than the tablet cases are mounted) may be mounted so as to be drawn out.

Figure 40:
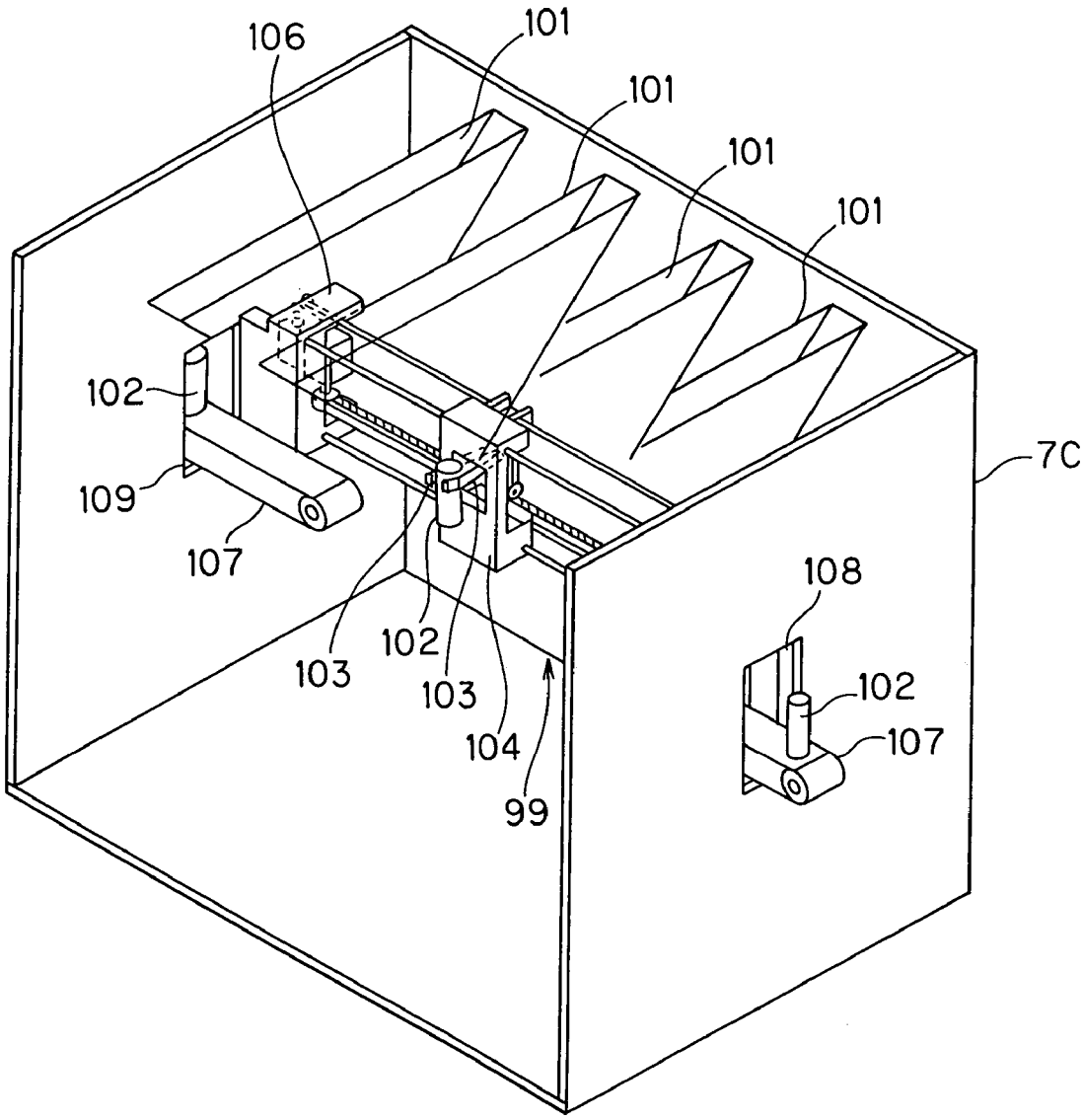
FIG. 40 is a perspective view showing another embodiment of the drawer of the medicine supply apparatus of FIG. 1.

FIG. 40 shows another lower structure 7C. The lower structure 7C can be also connected to the lower end of the upper structure 7A, and it constitutes the medicine supply apparatus 1 while connected to the upper structure 7*a*. A bottling machine 99 is secured as a charging apparatus in the lower structure 7, and four hoppers 101 are juxtaposed with one another at the upper side of the bottling machine 99 so as to face the lower ends of the respective chutes 32 of the upper structure 7A. No shutter 53 is equipped.

The bottling machine 99 comprises a catcher 104 having griping arms 103 which can grip a bottle 102 as a container, a feeding device 106 for moving the catcher 104 in the right-and-left direction and in the up-and-down direction, a conveyor 107 for feeding the bottle 102, etc. A bottle fed from an insertion port 109 by the conveyor 107 is gripped by the griping arms 103 of the catcher 104, and under this state the feeding device 106 feeds the bottle 102 concerned to the lower side of the lower end opening of the hopper 101 to which medicines are discharged and fall. Accordingly, the medicines are charged in the bottle 102. The bottle 102 charged with the medicines is fed to the take-out port 108 by the conveyor 107.

Here, in addition to the lower structure in which the packaging machine 13 or the bottling machine 99 described above is accommodated, a lower structure in which a charging apparatus called as a blister packaging machine is accommodated may be considered. When the lower structures 7B and 7C equipped with the different types of charging apparatuses as described above are designed to be selectively joined to the lower side of the common upper structure 7A, it is unnecessary to prepare for both the medicine supply apparatus which are equipped with the case accommodating portion containing the tablet cases and the different charging apparatuses, respectively. Therefore, versatility can be remarkably enhanced, and the production cost can be reduced.

In this embodiment, data input to the medicine supply apparatus 1 is carried out by the personal computer PC which is separately equipped. However, alternatively or in addition, there may be adopted a method of securing a control panel 111 to the door panel 6 of any drawer 2 and inputting data such as a medical prescription or the like from the control panel 111 or displaying an alarm there.

Figure 43:
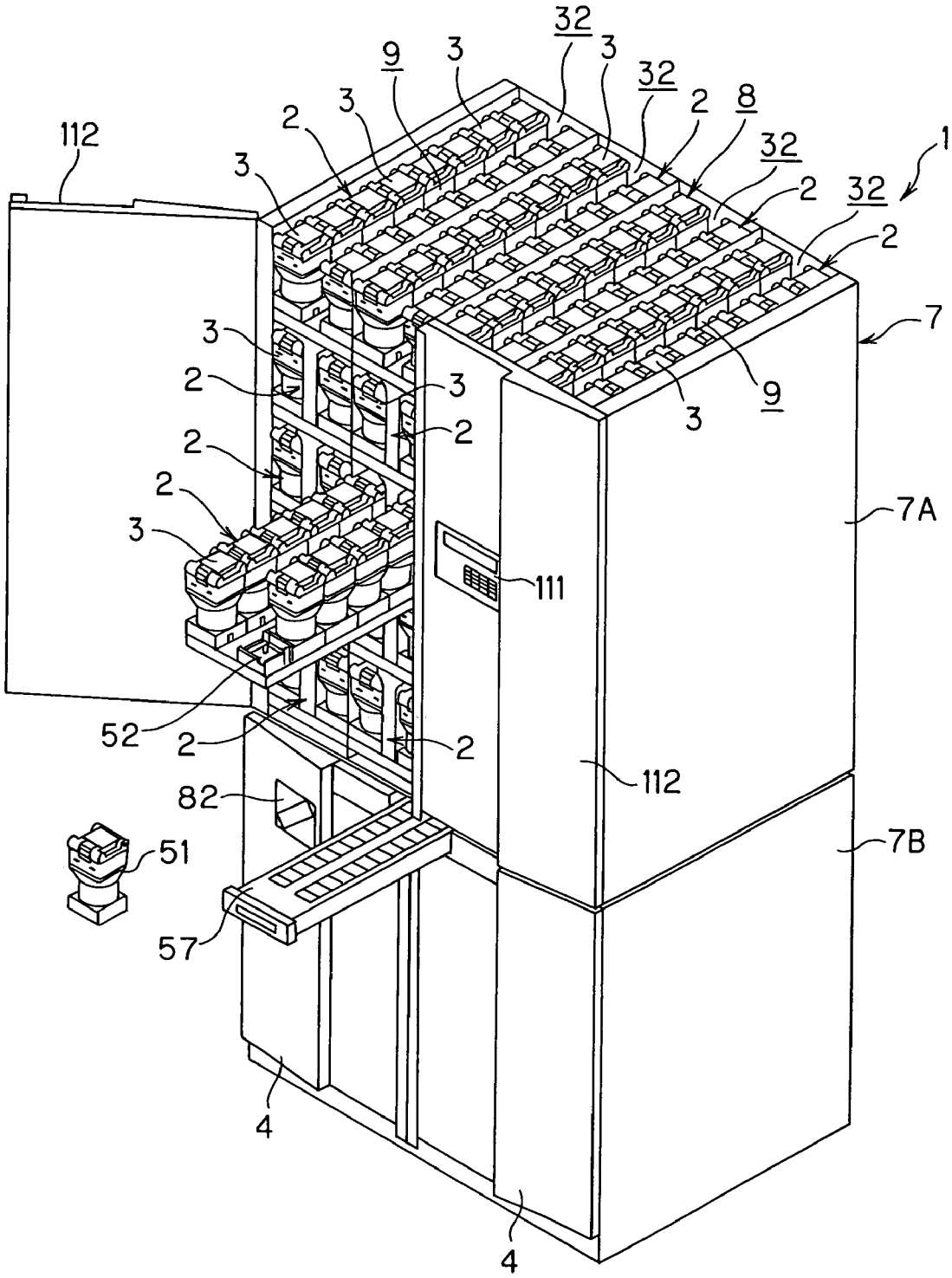
FIG. 43 is a perspective view the medicine supply apparatus (excluding a top board) of another embodiment of the present invention.

In this embodiment, the plural drawers 2 which are accommodated in the case accommodating portion 8 so as to be freely drawn out are equipped with the door panels 6 to close the opening of the front face of the upper structure 7A (case accommodating portion 8), however, the present invention is not limited to this embodiment. For example, as shown in FIG. 43, no door panel is secured to each drawer 2, and the opening of the front face of the upper structure 7A is closed to be freely opened/closed by double-doored upper panels 112. In this case, the lock operation for prohibiting the draw-out of all the drawers 2 is performed by locking the upper panels 112.

As described above, according to the present invention, drawers of plural stages in the up-and-down direction are equipped in the case accommodating portion of the main body, plural tablet cases are mounted on each drawer, and each drawer is mounted so as to be freely drawn out from the case accommodating portion. Therefore, when a tablet case is supplemented with medicines or exchanged by another tablet case, it can be performed by drawing out each drawer.

Accordingly, as compared with the structure that drawers in the up-and-down direction are simultaneously drawn out, the gap to be formed between the upper and lower drawers for supplement or exchange of medicines can be reduced more greatly, and thus the number of tablet cases to be accommodated in the case accommodating portion can be increased with suppressing increase of the dimension of the overall medicine supply apparatus.

Furthermore, the main body is constructed by the upper structure in which the tablet cases are equipped and the lower structure in which the charging apparatus is equipped, and also each of the plural lower structures which are respectively equipped with different charging apparatuses in accordance with the types of containers charged with medicines can be selectively joined to the upper structure. Therefore, a lower structure equipped with any one of a packaging machine for charging and packaging medicines in packaging paper, a bottling machine for bottling medicines and a blister packaging machine can be selectively joined to the upper structure, so that the upper structure can be commonly used and thus it is unnecessary to prepare for plural medicine supply apparatuses which are equipped with tablet cases and different charging apparatuses, respectively. That is, a lower structure having a charging apparatus matched with an application is used while joined to the upper structure, so that the versatility can be remarkably enhanced and the production cost and the part management cost can be remarkably reduced.

Furthermore, the tablet cases, the hopper and the charging apparatuses are mounted in the medicine supply apparatus so that they can be drawn out from the main body and detached therefrom. Therefore, in the case of maintenance such as exchange of a tablet case, cleaning of a hopper, part exchange of a charging apparatus, etc., the detaching work of these elements is carried out under the state that they are drawn out from the main body. Accordingly, the maintenance workability of the medicine supply apparatus can be remarkably enhanced, and medicines can be smoothly charged.

INDUSTRIAL APPLICABILITY

As described above, according to the present invention, drawers on which plural tablet cases of medicines can be mounted are equipped over plural stages in the up-and-down direction in the upper structure (case accommodating portion) of the main body, each drawer can be freely drawn out from the case accommodating portion, and the charging apparatus in the lower structure can be drawn out from the main body. The lower structure can be freely joined to the upper structure, so that many tablet cases can be accommodated with suppressing increase in size of the apparatus. Furthermore, the tablet case accommodating portion can be commonly used, and any charging apparatus can be freely joined to the common tablet case accommodating portion in accordance with the type of containers containing medicines.

The invention claimed is:

1. A medicine supply apparatus comprising a plurality of tablet cases equipped in a case accommodating portion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that a plurality of drawers are arranged in the horizontal and vertical directions in the case accommodating portion so as to be freely drawn out independently of one another in each of the horizontal and vertical directions, and the tablet cases are detachably mounted on the drawers, each of said drawers having a centrally located vertically extending passage therein, said tablet cases being mounted on both sides of the respective passages, each of said passages being sized and positioned to mutually communicate with one another when the drawers are received in the case accommodating portion to form a continuous passage in the vertical direction.

2. The medicine supply apparatus according to claim 1, wherein each of the drawers is designed so that tablet cases can be mounted thereon or no tablet case is mounted thereon.

3. The medicine supply apparatus according to claim 2, wherein the different types of tablet cases are tablet cases which are different in size or shape or different in the type of medicines to be accommodated in the tablet cases.

4. The medicine supply apparatus according to claim 1, wherein each of the drawers is designed so that different types of tablet cases and corresponding tablet cases can be mounted thereon.

5. A medicine supply apparatus comprising a plurality of tablet cases equipped in a case accommodating portion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that a plurality of drawers are arranged in the horizontal and vertical directions in the case accommodating portion so as to be freely drawn out independently of one another in each of the horizontal and vertical directions, and the tablet cases are detachably mounted on the drawers, each of the drawers has a passage passing in an up-and-down direction at the center thereof, the tablet cases are mounted at both the sides of the respective passages, and the passages of the respective drawers mutually intercommunicate with one another under a state that the drawers are accommodated in the case accommodating portion, thereby constructing the chutes linked to one another in the up-and-down direction, said medicine supply apparatus further comprising an additional unit connected to the upper side of the main body, wherein a plurality of drawers are equipped in the additional unit so as to be freely drawn out, tablet cases are detachably mounted on the drawers, and under a state that the plural drawers of the additional unit are accommodated in the additional unit, passages which are equipped at the centers of the drawers of the additional unit and intercommunicate with one another in the up-and-down direction intercommunicate with the passages of the drawers accommodated in the case accommodating portion, thereby constructing chutes continuously extending from the additional unit through the case accommodating portion in the up-and-down direction.

6. A medicine supply apparatus comprising a plurality of tablet cases equipped in a case accommodating portion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that the tablet cases are mounted on drawers arranged in the horizontal and vertical directions in the case accommodating portion so as to be freely drawn out independently of one another in each of the horizontal and vertical directions, the hopper and the charging apparatus are equipped so as to be allowed to be drawn out and detached from the main body, each of the drawers has a passage passing in an up-and-down direction at the center thereof, the tablet cases are mounted at both the sides of the respective passages, and the passages of the respective drawers mutually intercommunicate with one another under a state that the drawers are accommodated in the case accommodating portion, thereby constructing the chutes linked to one another in the up-and-down direction, said medicine supply apparatus further comprising regulating means for prohibiting adjacent drawers from being simultaneously drawn out.

7. The medicine supply apparatus according to claim 6, wherein the drawers are equipped on plural columns in the right-and-left direction and plural stages in the up-and-down direction in the case accommodating portion, and the regulating means prohibits drawers adjacent to each other on a column basis or a stage basis from being simultaneously drawn out.

8. The medicine supply apparatus according to claim 7, wherein the regulating means comprises a stay which is rotatably disposed at the rear side of the inside of the case accommodating portion so as to correspond to the rear portions of the drawers located on each colunm or stage, and upon draw-out of any drawer, the stay prohibits draw-out of other drawers located on the same colunm or stage as the drawer concerned.

9. The medicine supply apparatus according to claim 6, further comprising lock means for prohibiting draw-out of the drawers.

10. The medicine supply apparatus according to claim 9, wherein the lock means is of an electric motor-driven type.

11. The medicine supply apparatus according to claim 9, wherein the operation of the lock means is prohibited when any drawer is drawn out.

12. The medicine supply apparatus according to claim 9, further comprising lock release means for releasing the lock means.

13. The medicine supply apparatus according to claim 12, wherein the lock retease means is of a manual type.

14. A medicine supply apparatus comprising a plurality of tablet cases equipped in a case accommodating portion of a main body thereof, each of the table cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that the main body comprises an upper structure in which the tablet cases are equipped, and a lower structure which is detachably joined to the lower side of the upper structure and in which the charging apparatus is set up, and any one of plural types of lower structures in which different charging apparatuses are respectively set up in accordance with the types of containers to be charged with medicines is selectively joined to the upper structure.

15. The medicine supply apparatus according to claim 14, wherein the charging apparatus comprises any one of a packaging machine for charging and packaging medicines in packaging paper, a bottling machine for bottling medicines and a blister packaging machine, and the lower structure in which any one of the packaging machine, the bottling machine and the blister packaging machine is mounted is selectively joined to the upper structure.

16. The medicine supply apparatus according to claim 15, further comprising a shutter which is detachably secured to the main body so as to be freely opened/closed and temporarily catches medicines falling from the chutes to the hopper.

17. The medicine supply apparatus according to claim 16, wherein the shutter and the hopper are equipped so as to be allowed to be simultaneously drawn out from the main body.

18. The medicine supply apparatus according to claim 16, wherein the shutter is equipped with a buffer member for absorbing impact of medicines falling from the chutes.

19. The medicine supply apparatus according to claim 18, wherein the shutter comprises a pair of slope walls which are separated from each other while inclining upwardly, and an opening/closing plate for freely opening/closing an opening formed between the lower ends of the slope walls, and the buffer member is downwardly suspended at the center between the slope walls so as to face the slope walls.

20. The medicine supply apparatus according to claim 19, wherein the lower end of the buffer member extends further downwardly from the opening.

21. The medicine supply apparatus according to claim 20, wherein the lower end of the buffer member extends downwardly so as to be pinched by the opening/closing plate while the opening/closing plate is in a close state.

22. A medicine supply apparatus comprising a plurality of tablet cases equipped in a case accommodating portion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that the tablet cases are mounted on drawers arranged in the horizontal and vertical directions in the case accommodating portion so as to be freely drawn out independently of one another in each of the horizontal and vertical directions, the hopper and the charging apparatus are equipped so as to be allowed to be drawn out and detached from the main body, each of said drawers having a centrally located vertically extending passage therein, said tablet cases being mounted on both sides of the respective passages, each of said passages being sized and positioned to mutually communicate with one another when the drawers are received in the case accommodating portion to form a continuous passage in the vertical direction.

23. The medicine supply apparatus according to claim 22, wherein the tablet cases are equipped so that a plurality of tablet cases can be simultaneously drawn out and detached from the main body.

24. A medicine supply apparatus comprising a plurality of tablet cases equipped in a case accommodating ortion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that the tablet cases are mounted on drawers arranged in the horizontal and vertical directions in the case accommodating portion so as to be freely drawn out indenendently of one another in each of the horizontal and vertical directions, the hopper and the charging apparatus are equipped so as to be allowed to be drawn out and detached from the main body, said medicine supply apparatus further comprising a shutter which is equipped in the main body so as to be freely opened/closed and temporarily catch medicines falling from the chutes to the hopper, wherein the shutter is equipped so as to be allowed to be drawn out and detached from the main body.

25. The medicine supply apparatus according to claim 24, wherein the shutter and the hopper are equipped so as to be allowed to be simultaneously drawn out from the main body.

26. The medicine supply apparatus according to claim 24, wherein the shutter is equipped with a buffer member which is suspended and can absorb impact of medicines falling from the chutes.

27. The medicine supply apparatus according to claim 26, wherein the shutter comprises a pair of slope walls which are separated from each other while inclining upwardly, and an opening/closing plate for freely opening/closing an opening formed between the lower ends of the slope walls, and the buffer member is downwardly suspended at the center between the slope walls so as to face the slope walls.

28. The medicine supply apparatus according to claim 27, wherein the lower end of the buffer member extends further downwardly from the opening.

29. The medicine supply apparatus according to claim 28, wherein the lower end of the buffer member extends downwardly so as to be pinched by the opening/closing plate while the opening/closing plate is in a close state.

30. A medicine supply apparatus comprising a plurality of tablet cases equipped in a case accommodating portion of a main body thereof, each of the tablet cases having medicines accommodated therein, chutes through which medicines discharged from the tablet cases are passed, a hopper equipped so as to face the lower portions of the chutes, and a charging apparatus for charging a medicine accommodating container with medicines caught by the hopper, characterized in that the tablet cases are mounted on drawers arranged in the horizontal and vertical directions in the case accommodating portion so as to be freely drawn out independently of one another in each of the horizontal and vertical directions, the hopper and the charging apparatus are equipped so as to be allowed to be drawn out and detached from the main body, wherein the charging apparatus is equipped with heat-adhesive packaging paper wound in a roll shape and a nozzle which is inserted in the packaging paper continuously drawn out and puts medicines discharged from the tablet cases into the packaging paper, and the nozzle is designed to be freely swingable in a direction perpendicular to a feeding direction of the packaging paper.

* * * * *

UNITED STATES PATENT AND TRADEMARK OFFICE

CERTIFICATE OF CORRECTION

PATENT NO. : 7,293,672 B2
APPLICATION NO. : 10/505628
DATED : November 13, 2007
INVENTOR(S) : Takashi Mori et al.

It is certified that error appears in the above-identified patent and that said Letters Patent is hereby corrected as shown below:

In the Title:

Please delete "Chemical Feeding Device" arid insert --Medicine Supply Apparatus--.

In the Specification:

Please add the following paragraph after the title:

--Cross-Reference to Prior Application

This is a U.S. national phase application under 35 U.S.C. §371 of International Patent Application No. PCT/JP03/01635 filed February 17, 2003, and claims the benefit of Japanese Patent Application No. 2002-42468 filed February 20, 2002, Application No. 2002-42485 filed February 20, 2002 and Application No. 2002-42500 filed February 20, 2002 which are incorporated by reference herein. The International Application was published in Japanese on August 28, 2003 as WO 03/070574 A1 under PCT Article 21(2).--

Signed and Sealed this

Nineteenth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,293,672 B2
APPLICATION NO. : 10/505628
DATED : November 13, 2007
INVENTOR(S) : Takashi Mori et al.

It is certified that error appears in the above-identified patent and that said Letters Patent is hereby corrected as shown below:

In the Title Item [54] and Column 1, line 1:

Please delete "Chemical Feeding Device" arid insert --Medicine Supply Apparatus--.

In the Specification:

Please add the following paragraph after the title:

--Cross-Reference to Prior Application

This is a U.S. national phase application under 35 U.S.C. §371 of International Patent Application No. PCT/JP03/01635 filed February 17, 2003, and claims the benefit of Japanese Patent Application No. 2002-42468 filed February 20, 2002, Application No. 2002-42485 filed February 20, 2002 and Application No. 2002-42500 filed February 20, 2002 which are incorporated by reference herein. The International Application was published in Japanese on August 28, 2003 as WO 03/070574 A1 under PCT Article 21(2).--

This certificate supersedes the Certificate of Correction issued August 19, 2008.

Signed and Sealed this

Twenty-third Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,293,672 B2
APPLICATION NO. : 10/505628
DATED : November 13, 2007
INVENTOR(S) : Takashi Mori et al.

It is certified that error appears in the above-identified patent and that said Letters Patent is hereby corrected as shown below:

In the Title Item [54] and Column 1, line 1:

Please delete "Chemical Feeding Device" and insert --Medicine Supply Apparatus--.

In the Specification:

Please add the following paragraph after the title:

--Cross-Reference to Prior Application

This is a U.S. national phase application under 35 U.S.C. §371 of International Patent Application No. PCT/JP03/01635 filed February 17, 2003, and claims the benefit of Japanese Patent Application No. 2002-42468 filed February 20, 2002, Application No. 2002-42485 filed February 20, 2002 and Application No. 2002-42500 filed February 20, 2002 which are incorporated by reference herein. The International Application was published in Japanese on August 28, 2003 as WO 03/070574 A1 under PCT Article 21(2).--

Figure 18:
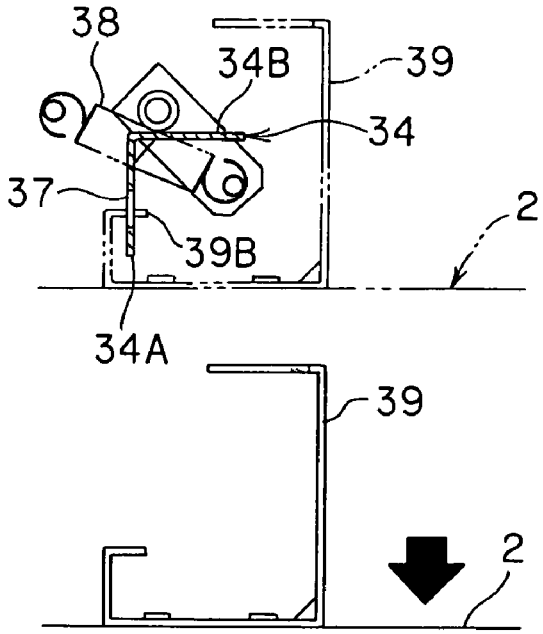
FIG. 18 is a diagram showing the operation of the stay of the medicine supply apparatus of FIG. 1.
Figure 19:
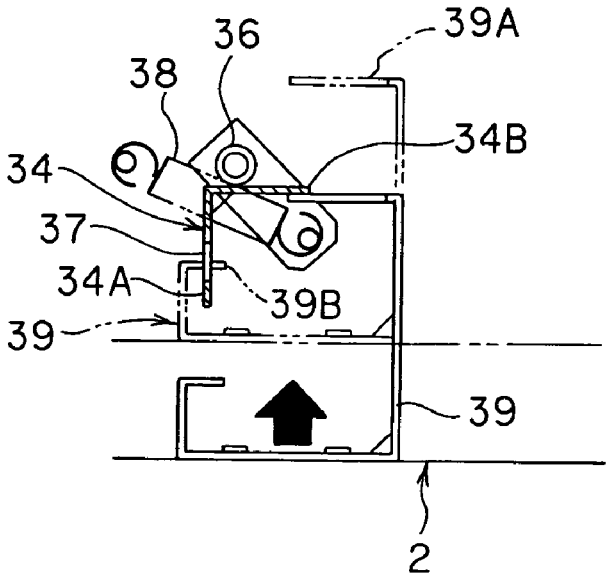
FIG. 19 is a diagram showing the operation of the stay of the medicine supply apparatus of FIG. 1.
Figure 20:
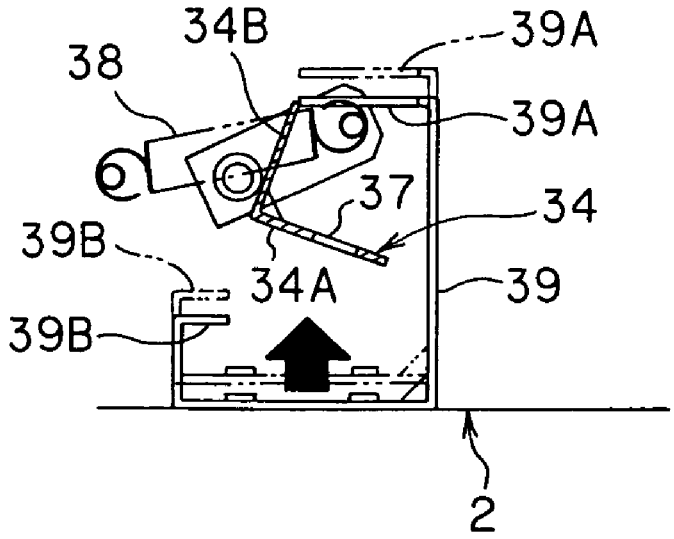
FIG. 20 is a diagram showing the operation of the stay of the medicine supply apparatus of FIG. 1.
Figure 21:
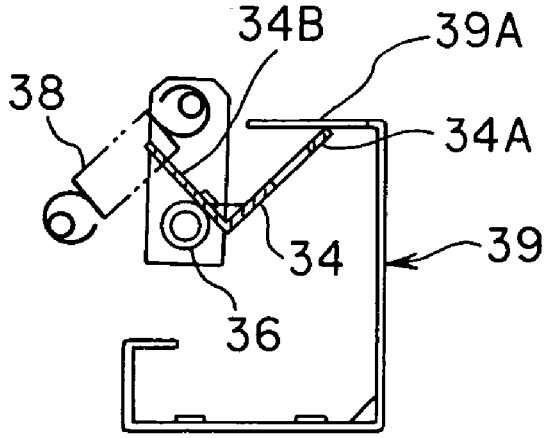
FIG. 21 is a diagram showing the operation of the stay of the medicine supply apparatus shown in FIG. 1.
Figure 25:
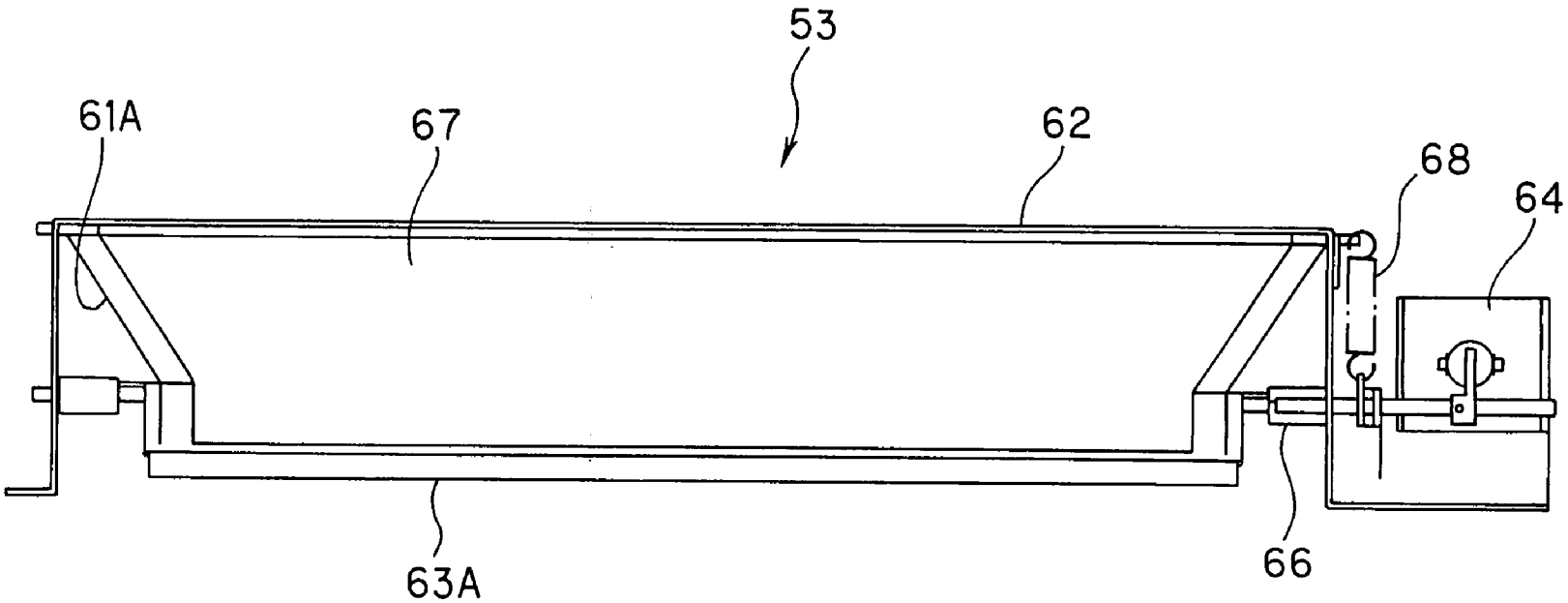
FIG. 25 is a longitudinally-sectional side view showing a shutter of the medicine supply apparatus of FIG. 1.
Figure 26:
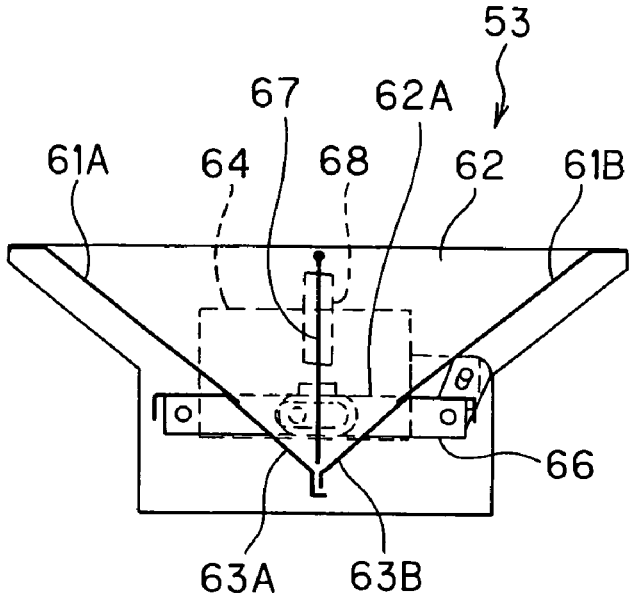
FIG. 26 is a longitudinally-sectional front view of the shutter of the medicine supply apparatus of FIG. 1.
Figure 27:
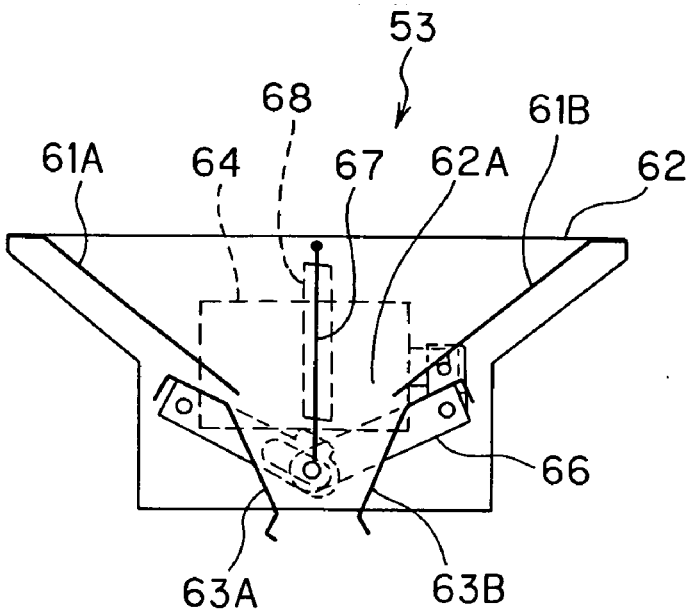
FIG. 27 is another longitudinally sectional front view of the shutter of the medicine supply apparatus of FIG. 1.
Figure 28:
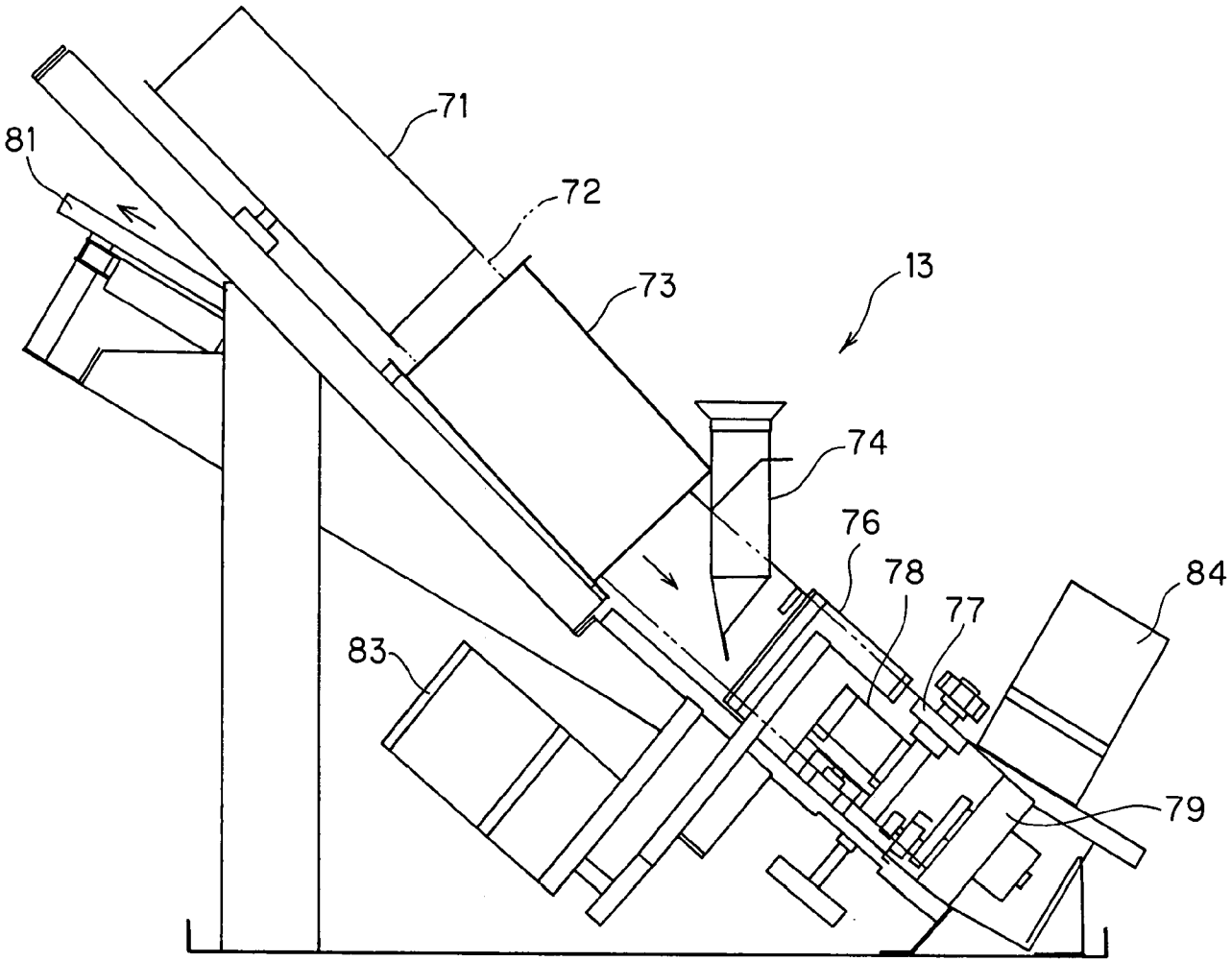
FIG. 28 is a front view showing a packaging machine of the medicine supply apparatus of FIG. 1.
Figure 41:
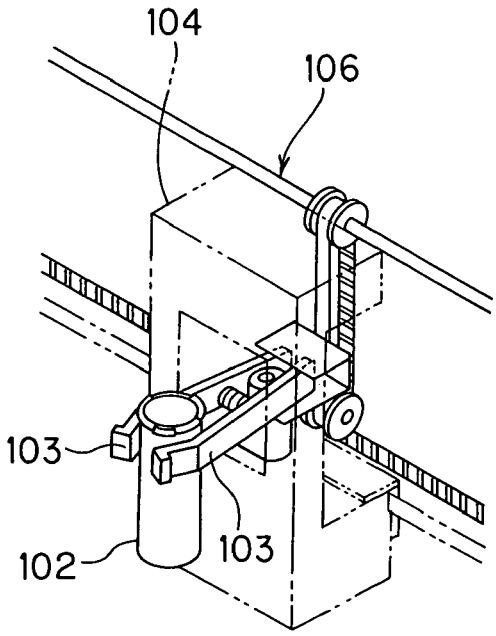
FIG. 41 is a perspective view showing a catcher portion of a lower structure.
Figure 42:
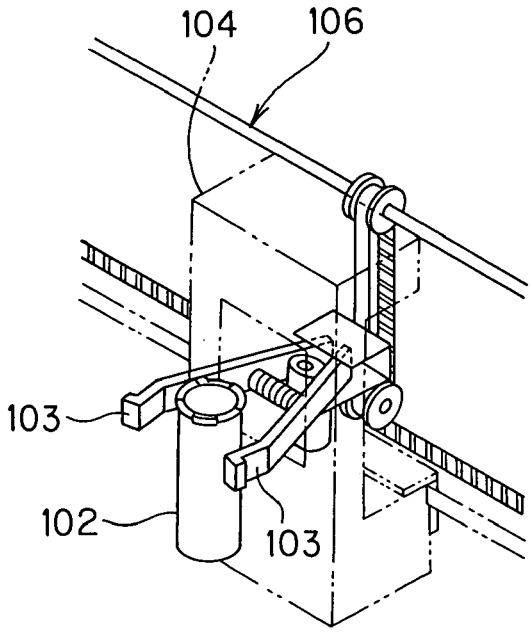
FIG. 42 is another perspective view showing the catcher portion of the lower structure of FIG. 40.

Please replace the full paragraph that begins on page 11 after the BRIEF DESCRIPTION OF THE DRAWINGS and ends on page 13 with the following:

--Fig. 1 is a perspective view of a medicine supply apparatus according to an embodiment of the present invention (excluding a top board), Fig. 2 is a front view of the medicine supply apparatus of Fig. 1 when a cover panel of each drawer is detached and a lower panel is opened, Fig. 3 is a side view of the medicine supply apparatus of Fig. 1 with covers removed, Fig. 4 is another front view of the medicine supply apparatus shown in Fig. 1, Fig. 5 is a side view of the medicine supply apparatus, Fig. 6 is a plan view of the medicine supply apparatus shown in Fig. 1, Fig. 7 is a perspective view of drawers of the medicine supply apparatus shown in Fig. 1, Fig. 8 is a perspective view showing the drawers of Fig. 7 when the accommodating container of the tablet cases is detached, Fig. 9 is a perspective view of the accommodating container of the tablet cases of the medicine supply apparatus shown in Fig. 1, Fig. 10 is an exploded perspective view showing a driving base of the tablet case of the medicine supply apparatus of Fig. 1, Fig. 11 is a perspective view showing a shelve of the medicine supply apparatus and identifying sensors, Fig. 12 is a perspective view showing a tablet case and an identifying sensor of the medicine supply apparatus of Fig. 1, Fig. 13 is a perspective front view showing the relationship between the shelve and a stay in the medicine supply apparatus of Fig. 1, Fig. 14 is a perspective front view showing the positional relationship of the stays of the medicine supply apparatus of Fig. 1, Fig. 15 is a perspective side view showing the relationship between the drawer and the stay in the medicine supply apparatus of Fig. 1, Fig. 16 is a diagram showing the It is certified that error appears in the above-identified patent and that said Letters Patent is hereby corrected as shown below:

operation of the stay of the medicine supply apparatus of Fig. 1, Fig. 17 is a diagram showing the operation of the stay of the medicine supply apparatus of Fig. 1, Fig. 18 is a diagram showing the operation of the stay of the medicine supply apparatus of Fig. 1, Fig. 19 is a diagram showing the operation of the stay of the medicine supply apparatus of Fig. 1, Fig. 20 is a diagram showing the operation of the stay of the medicine supply apparatus of Fig. 1, Fig. 21 is a diagram showing the operation of the stay of the medicine supply apparatus shown in Fig. 1, Fig. 22 is a diagram showing the operation of a solenoid of the medicine supply apparatus of Fig. 1, Fig. 23 is a diagram showing the operation of the solenoid of the medicine supply apparatus of Fig. 1, Fig. 24 is a diagram showing the operation of a lock release lever of the medicine supply apparatus of Fig. 1, Fig. 25 is a longitudinally-sectional side view showing a shutter of the medicine supply apparatus of Fig. 1, Fig. 26 is a longitudinally-sectional front view of the shutter of the medicine supply apparatus of Fig. 1, Fig. 27 is another longitudinally sectional front view of the shutter of the medicine supply apparatus of Fig. 1, Fig. 28 is a front view showing a packaging machine of the medicine supply apparatus of Fig. 1, Fig. 29 is a perspective view showing a nozzle of the medicine supply apparatus of Fig. 1, Fig. 30 is a perspective view showing a printer of the medicine supply apparatus of Fig. 1, Fig. 31 is a diagram showing the positional relationship between a printer head and a heat seal head to packaging paper in the medicine supply apparatus of Fig. 1, Fig. 32 is a diagram showing a print result to the packaging paper in the medicine supply apparatus of Fig. 1, Fig. 33 is a diagram showing another example of the print result to packaging paper in the medicine supply apparatus of Fig. 1, Fig. 34 is a block diagram showing an electrical circuit of a controller of the medicine supply apparatus of Fig. 1, Fig. 35 is a perspective view showing an extension unit of the medicine supply apparatus of Fig. 1, Fig. 36 is a perspective view showing another example the drawer of the medicine supply apparatus of Fig. 1, Fig. 37 is a perspective view showing another embodiment of the drawer of the medicine supply apparatus shown in Fig. 1, Fig. 38 is a perspective view showing another embodiment of the drawer of the medicine supply apparatus of Fig. 1, Fig. 39 is a perspective view showing another embodiment of the drawer of the medicine supply apparatus of Fig. 1, Fig. 40 is a perspective view showing another embodiment of the drawer of the medicine supply apparatus of Fig. 1, Fig. 41 is a perspective view showing a catcher portion of a lower structure, Fig. 42 is another perspective view showing the catcher portion of the lower

UNITED STATES PATENT AND TRADEMARK OFFICE

CERTIFICATE OF CORRECTION

PATENT NO. : 7,293,672 B2
APPLICATION NO. : 10/505628
DATED : November 13, 2007
INVENTOR(S) : Takashi Mori et al.

It is certified that error appears in the above-identified patent and that said Letters Patent is hereby corrected as shown below:

structure of Fig. 40, and Fig. 43 is a perspective view the medicine supply apparatus (excluding a top board)of another embodiment of the present invention.--

This certificate supersedes the Certificates of Correction issued August 19, 2008 and September 23, 2008.

Signed and Sealed this

Twenty-eighth Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,293,672 B2
APPLICATION NO. : 10/505628
DATED : November 13, 2007
INVENTOR(S) : Takashi Mori et al.

It is certified that error appears in the above-identified patent and that said Letters Patent is hereby corrected as shown below:

In the Cover Page:

Item (73) Assignee should read
--Sanyo Electric Biomedical Co. Ltd., Moriguchi-Shi, Osaka, Japan--

Signed and Sealed this
First Day of February, 2011

David J. Kappos

David J. Kappos
*Director of the United States Patent and Trademark Office*